US008396717B2

(12) United States Patent
Oshikiri

(10) Patent No.: US 8,396,717 B2
(45) Date of Patent: Mar. 12, 2013

(54) SPEECH ENCODING APPARATUS AND SPEECH ENCODING METHOD

(75) Inventor: Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1370 days.

(21) Appl. No.: 12/088,300

(22) PCT Filed: Sep. 29, 2006

(86) PCT No.: PCT/JP2006/319438
§ 371 (c)(1),
(2), (4) Date: Mar. 27, 2008

(87) PCT Pub. No.: WO2007/037361
PCT Pub. Date: Apr. 5, 2007

(65) Prior Publication Data

US 2009/0157413 A1 Jun. 18, 2009

(30) Foreign Application Priority Data

Sep. 30, 2005 (JP) ..... 2005-286533
Jul. 21, 2006 (JP) ..... 2006-199616

(51) Int. Cl.
*G10L 21/04* (2006.01)

(52) U.S. Cl. ..... 704/501

(58) Field of Classification Search ..... 704/219, 704/500–504
See application file for complete search history.

(56) References Cited

U.S. PATENT DOCUMENTS 6,680,972 B1 1/2004 Liljerdy et al.
7,003,451 B2 2/2006 Kjorling et al.
7,433,817 B2 10/2008 Kjorling et al.
7,469,206 B2 12/2008 Kjorling et al.
2002/0087304 A1 7/2002 Kjorling et al.
(Continued)

FOREIGN PATENT DOCUMENTS

JP 9-153811 6/1997
JP 2001-521648 11/2001
JP 2004-514179 5/2004
(Continued)

OTHER PUBLICATIONS

Enbom N et al., "Bandwidth expansion of speech based on vector quantization of the mel frequency cepstral coefficients", Speech Coding Proceedings, 1999 IEEE Workshop on Porvoo, Finland Jun. 20-23, 1999, Piscataway, NJ, USA, IEEE, US, Jun. 20, 1999, pp. 171-173; XP010345574.

(Continued)

*Primary Examiner* — Angela A Armstrong
(74) *Attorney, Agent, or Firm* — Greenblum & Bernstein, P.L.C.

(57) ABSTRACT

There is provided an audio encoding device capable of maintaining continuity of spectrum energy and preventing degradation of audio quality even when a spectrum of a low range of an audio signal is copied at a high range a plurality of times. The audio encoding device (100) includes: an LPC quantization unit (102) for quantizing an LPC coefficient; an LPC decoding unit (103) for decoding the quantized LPC coefficient; an inverse filter unit (104) for flattening the spectrum of the input audio signal by the inverse filter configured by using the decoding LPC coefficient; a frequency region conversion unit (105) for frequency-analyzing the flattened spectrum; a first layer encoding unit (106) for encoding the low range of the flattened spectrum to generate first layer encoded data; a first layer decoding unit (107) for decoding the first layer encoded data to generate a first layer decoded spectrum, and a second layer encoding unit (108) for encoding.

10 Claims, 34 Drawing Sheets

U.S. PATENT DOCUMENTS

| | | | | |
|---|---|---|---|---|
| 2005/0091051 | A1* | 4/2005 | Moriya et al. | 704/229 |
| 2005/0096917 | A1 | 5/2005 | Kjorling et al. | |
| 2006/0036432 | A1 | 2/2006 | Kjorling et al. | |
| 2006/0239473 | A1* | 10/2006 | Kjorling et al. | 381/98 |
| 2007/0088542 | A1* | 4/2007 | Vos et al. | 704/219 |
| 2007/0299669 | A1 | 12/2007 | Ehara | |
| 2008/0052066 | A1 | 2/2008 | Oshikiri et al. | |
| 2008/0065373 | A1 | 3/2008 | Oshikiri | |
| 2008/0091419 | A1 | 4/2008 | Yoshida et al. | |
| 2008/0091440 | A1 | 4/2008 | Oshikiri | |
| 2008/0126086 | A1* | 5/2008 | Vos et al. | 704/225 |
| 2009/0132261 | A1 | 5/2009 | Kjorling et al. | |
| 2009/0326929 | A1 | 12/2009 | Kjorling et al. | |

FOREIGN PATENT DOCUMENTS

| | | |
|---|---|---|
| JP | 2004-62410 | 3/2005 |
| JP | 2005-62410 | 3/2005 |
| WO | 98/57436 | 12/1998 |
| WO | 02/41301 | 5/2002 |
| WO | 03/046891 | 6/2003 |

OTHER PUBLICATIONS

"3GPP-Standards", 2500 Wilson Boulevard, Suite 300, Arlington, Virginia 22201 USA, May 2004, pp. 1-35; XP040292614.

Search report from E.P.O., mail date is Dec. 28, 2010.

English language Abstract of JP 2004-514179.

English language Abstract of JP 2004-62410.

English language Abstract of JP 2001-521648.

English language Abstract of JP 9-153811.

Oshikiri et al., "Pitch Filtering ni Motozuku Spectrum Fugoka o Mochiita Chokotaiiki Scalable Onsei Fugoka no Kaizen", The Acoustical Society of Japan (ASJ) 2004 Nen Shuki Kenkyu Happyokai Koen Ronbunshu -I- , Sep. 21, 2004, pp. 297-298.

"Everything about MPEG-4" (MPEG-4 no subete), first edition, written and edited by Sukeichi Miki, Kogyo Chosakai Publishing, Inc,. Sep. 30, 1998, pp. 126-127.

English language Abstract of JP 2005-62410.

* cited by examiner

SPEECH ENCODING APPARATUS AND SPEECH ENCODING METHOD

TECHNICAL FIELD

The present invention relates to a speech encoding apparatus and speech encoding method.

BACKGROUND ART

A mobile communication system is required to compress a speech signal to a low bit rate for effective use of radio resources.

Further, improvement of communication speech quality and realization of a communication service of high actuality are demanded. To meet these demands, it is preferable to make quality of speech signals high and encode signals other than the speech signals, such as audio signals in wider bands, with high quality.

A technique for integrating a plurality of encoding techniques in layers for these contradicting demands is regarded as promising. To be more specific, this technique refers to integrating in layers the first layer where an input signal according to a model suitable for a speech signal is encoded at a low bit rate and the second layer where an differential signal between the input signal and the first layer decoded signal is encoded according to a model suitable for signals other than speech. An encoding scheme with such a layered structure includes features that, even if a portion of an encoded bit stream is discarded, the decoded signal can be obtained from the rest of information, that is, scalability, and so is referred to as "scalable encoding." Based on these features, scalable encoding can flexibly support communication between networks of different bit rates. Further, these features are suitable for the network environment in the future where various networks are integrated through the IP protocol.

Some conventional scalable encoding employs a standardized technique with MPEG-4 (Moving Picture Experts Group phase-4) (for example, see Non-Patent Document 1). In scalable encoding disclosed in Non-Patent Document 1, CELP (code excited linear prediction) suitable for speech signals is used in the first layer and transform encoding such as AAC (advanced audio coder) and TwinVQ (transform domain weighted interleave vector quantization) is used in the second layer when encoding the residual signal obtained by removing the first layer decoded signal from the original signal.

On the other hand, in transform encoding, there is a technique for encoding a spectrum efficiently (for example, see Patent Document 1). The technique disclosed in Patent Document 1 refers to dividing the frequency band of a speech signal into two subbands of a low band and a high band, duplicating the low band spectrum to the high band and obtaining the high band spectrum by modifying the duplicated spectrum. In this case, it is possible realize lower bit rate by encoding modification information with a small number of bits.

Non-Patent Document 1: "Everything about MPEG-4" (MPEG-4 no subete), the first edition, written and edited by Sukeichi MIKI, Kogyo Chosakai Publishing, Inc., Sep. 30, 1998, page 126 to 127.

Patent Document Japanese translation of a PCT Application Laid-Open No. 2001-521648

DISCLOSURE OF INVENTION

Problems to be Solved by the Invention

Generally, the spectrum of a speech signal or an audio signal is represented by the product of the component (spectral envelope) that changes moderately with the frequency and the component (spectral fine structure) that shows rapid changes. As an example, FIG. 1 shows the spectrum of a speech signal, FIG. 2 shows the spectral envelope and FIG. 3 shows the spectral fine structure. This spectral envelope (FIG. 2) is calculated using LPC (Linear Prediction Coding) coefficients of order ten. According to these drawings, the product of the spectral envelope (FIG. 2) and the spectral fine structure (FIG. 3) is the spectrum of a speech signal (FIG. 1).

Here, when the high band spectrum is generated by duplicating the low band spectrum, if the bandwidth of the high band, which is the duplication destination, is wider than the bandwidth of the low band, which is the duplication source, the low band spectrum is duplicated to the high band two times or more. For example, when the low band spectrum (0 to FL) of FIG. 1 is duplicated to the high band (FL to FH), in this example, FH=2*FL, and so the low band spectrum needs to be duplicated to the high band two times. When the low band spectrum is duplicated to the high band a plurality of times in this way, as shown in FIG. 4, discontinuity in spectral energy occurs at a connecting portion of the spectrum at the duplication destination. The spectral envelope causes such discontinuity. As shown in FIG. 2, in the spectral envelope, when the frequency increases, energy decreases, and so the spectral slope is generated. There is such a spectral slope, and, consequently, when the low band spectrum is duplicated to the high band a plurality of times, discontinuity in spectral energy occurs and speech quality deteriorates. It is possible to correct this discontinuity by gain adjustment, but gain adjustment requires a large number of bits to obtain a satisfying effect.

It is an object of the present invention to provide a speech encoding apparatus and a speech encoding method that, when the low band spectrum is duplicated to the high band a plurality of times, keep continuity in spectral energy and prevent speech quality deterioration.

Means for Solving the Problem

The speech encoding apparatus according to the present invention employs a configuration including: a first encoding section that encodes a low band spectrum comprising a lower band than a threshold frequency of a speech signal; a flattening section that flattens the low band spectrum using an inverse filter with inverse characteristics of a spectral envelope of the speech signal; and a second encoding section that encodes a high band spectrum comprising a higher band than the threshold frequency of the speech signal using the flattened low band spectrum.

Advantageous Effect of the Invention

The present invention is able to keep continuity in spectral energy and prevent speech quality deterioration.

BEST MODE FOR CARRYING OUT THE INVENTION

When carrying out encoding of the high band utilizing the low band spectrum, the present invention flattens the spectrum by removing the influence of the spectral envelope from the low band spectrum and encodes the high band spectrum using the flattened spectrum.

First, the operation principle of the present invention will be described with reference to FIGS. 5A to D.

In FIGS. 5A to D, with FL as the threshold frequency, 0 to FL is the low band and FL to FH is the high band.

Figure 5A:
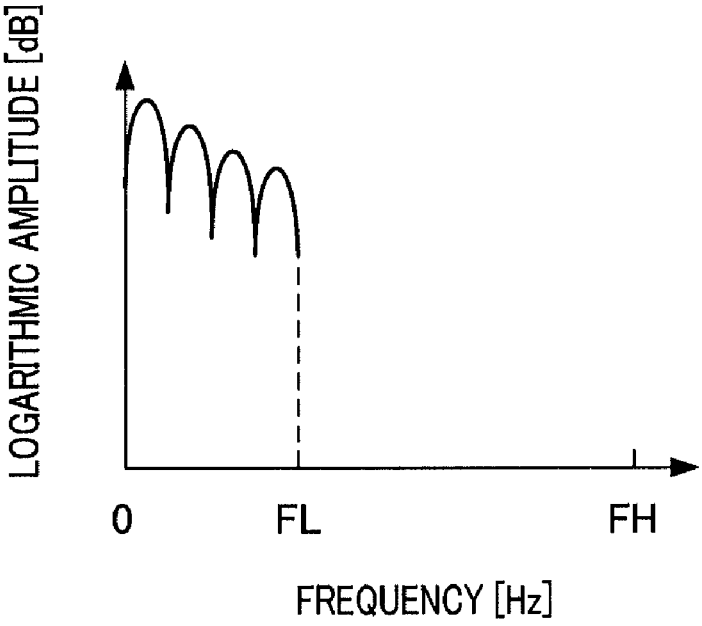
FIG. 5A illustrates the operation principle according to the present invention (i.e. low band decoded spectrum)
Figure 5B:
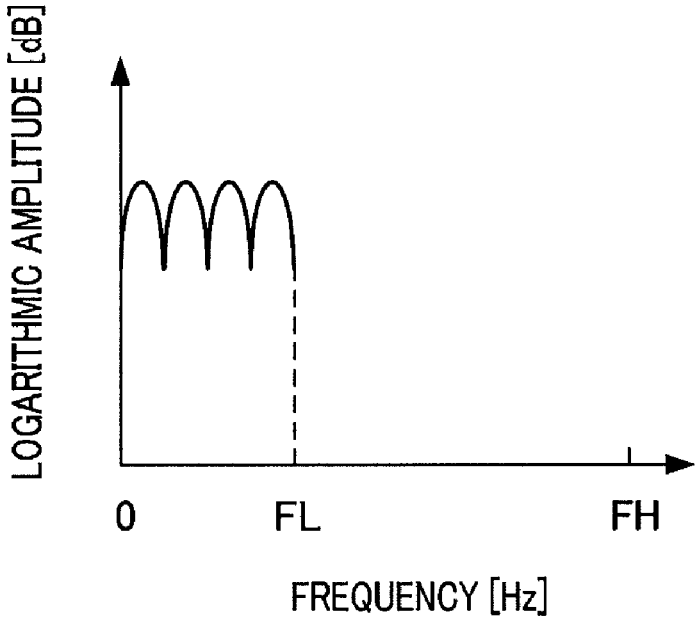
FIG. 5B illustrates the operation principle according to the present invention (i.e. the spectrum that has passed through an inverse filter)
Figure 5C:
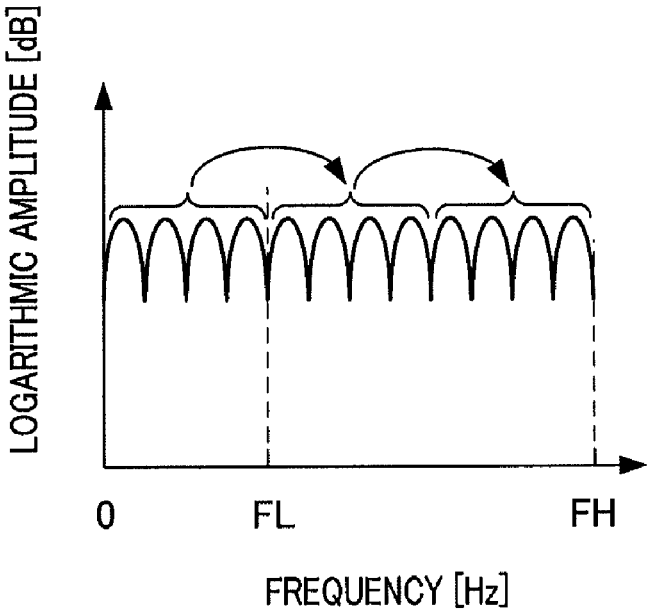
FIG. 5C illustrates the operation principle according to the present invention (i.e. encoding of the high band)
Figure 5D:
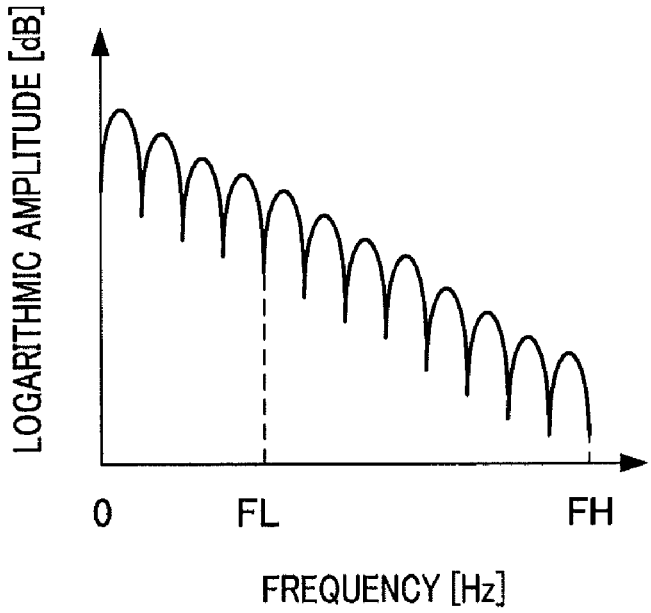
FIG. 5D illustrates the operation principle according to the present invention (i.e. the spectrum of a decoded signal)

FIG. 5A shows a low band decoded spectrum obtained by conventional encoding/decoding processing. FIG. 5B shows the spectrum obtained by filtering the decoded spectrum shown in FIG. 5A through an inverse filter with inverse characteristics of the spectral envelope. In this way, by filtering the low band decoded spectrum through the inverse filter with the inverse characteristics of the spectral envelope, the low band spectrum is flattened. Then, as shown in FIG. 5C, The low band spectrum is duplicated to the high band a plurality of times (here, two times), and the high band is encoded. The low band spectrum is already flattened as shown in FIG. 5B, and so, when the high band is encoded, discontinuity in spectral energy caused by the spectral envelope such as described above does not occur. Then, by adding the spectral envelope to the spectrum with a signal band extended to 0 to FH, the spectrum of a decoded signal as shown in FIG. 5D can be obtained.

Further, as a encoding method of the high band, a method can be employed for estimating the high band spectrum by using the low band spectrum for the internal state of a pitch filter and carrying out pitch filter processing in order from lower frequency to higher frequency in the frequency domain. According to this encoding method, when the high band is encoded, only filter information of the pitch filter needs to be encoded, so that it is possible to realize a lower bit rate.

Hereinafter, embodiments of the present invention will be described in detail with reference to accompanying drawings.

Embodiment 1

A case will be described here with this embodiment where frequency domain encoding is carried out both for the first layer and the second layer. Further, in this embodiment, after the low band spectrum is flattened, the high band spectrum is encoded by repeatedly utilizing the flattened spectrum.

Figure 6:
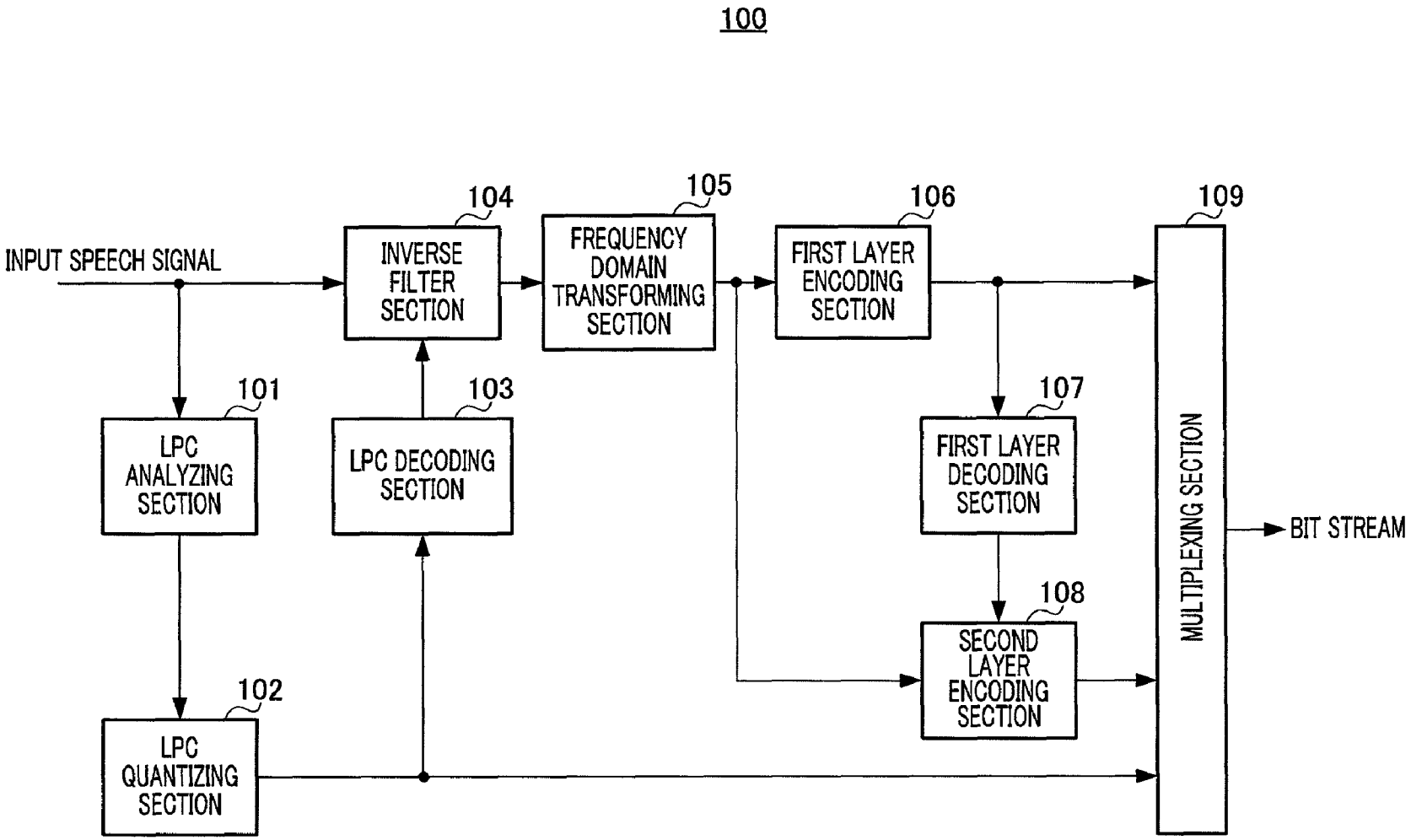
FIG. 6 is a block configuration diagram showing a speech encoding apparatus according to Embodiment 1 of the present invention.

FIG. 6 shows the configuration of a speech encoding apparatus according to Embodiment 1 of the present invention.

In speech encoding apparatus 100 shown in FIG. 6, LPC analyzing section 101 carries out LPC analysis of an input speech signal and calculates LPC coefficients $\alpha(i)$ ($1 \leqq i \leqq NP$). Here, NP is the order of the LPC coefficients, and, for example, 10 to 18 is selected. The calculated LPC coefficients are inputted to LPC quantizing section 102.

LPC quantizing section 102 quantizes the LPC coefficients. For efficiency and stability judgment in quantization, after the LPC coefficients are converted to LSP (Line Spectral Pair) parameters, LPC quantizing section 102 quantizes the LSP parameters and outputs LPC coefficient encoded data. The LPC coefficient encoded data is inputted to LPC decoding section 103 and multiplexing section 109.

LPC decoding section 103 generates decoded LPC coefficients $\alpha_q(i)$ ($1 \leqq i \leqq NP$) by decoding the LPC coefficient encoded data and outputs decoded LPC coefficients $\alpha_q(i)$ ($1 \leqq i \leqq NP$) to inverse filter section 104.

Inverse filter section 104 forms an inverse filter using the decoded LPC coefficients and flattens the spectrum of the input speech signal by filtering the input speech signal through this inverse filter.

The inverse filter is represented by equation 1 or equation 2. Equation 2 shows the inverse filter when a resonance suppression coefficient $\gamma(0<\gamma<1)$ for controlling the degree of flattening is used.

(Equation 1)

$$A(z) = 1 + \sum_{i=1}^{NP} \alpha_q(i) \cdot z^{-i} \quad [1]$$

(Equation 2)

$$A(z/\gamma) = 1 + \sum_{i=1}^{NP} \alpha_q(i) \cdot \gamma^i \cdot z^{-i} \quad [2]$$

Then, output signal e(n) obtained when speech signal s(n) is inputted to the inverse filter represented by equation 1, is represented by equation 3.

(Equation 3)

$$e(n) = s(n) + \sum_{i=1}^{NP} \alpha_q(i) \cdot s(n-i) \quad [3]$$

Similarly, output signal e(n) obtained when speech signal s(n) is inputted to the inverse filter represented by equation 2, is represented by equation 4.

(Equation 4)

$$e(n) = s(n) + \sum_{i=1}^{NP} \alpha_q(i) \cdot \gamma^i \cdot s(n-i) \quad [4]$$

In this way, the spectrum of the input speech signal is flattened by this inverse filter processing. Further, in the following description, an output signal of inverse filter section 104 (speech signal where the spectrum is flattened) is referred to as a "prediction residual signal."

Frequency domain transforming section 105 carries out a frequency analysis of the prediction residual signal outputted from inverse filter section 104 and finds a residual spectrum as transform coefficients. Frequency domain transforming section 105 transforms a time domain signal into a frequency domain signal using, for example, the MDCT (Modified Discrete Cosine Transform). The residual spectrum is inputted to first layer encoding section 106 and second layer encoding section 108.

First layer encoding section 106 encodes the low band of the residual spectrum using, for example, TwinVQ and outputs the first layer encoded data obtained by this encoding, to first layer decoding section 107 and multiplexing section 109.

First layer decoding section 107 generates a first layer decoded spectrum by decoding the first layer encoded data and outputs the first layer decoded spectrum to second layer encoding section 108. Further, first layer decoding section 107 outputs the first layer decoded spectrum before transform into the time domain.

Second layer encoding section 108 encodes the high band of the residual spectrum using the first layer decoded spectrum obtained at first layer decoding section 107 and outputs the second layer encoded data obtained by this encoding, to multiplexing section 109. Second layer encoding section 108 uses the first layer decoded spectrum for the internal state of the pitch filter and estimates the high band of the residual spectrum by pitch filtering processing. At this time, second layer encoding section 108 estimates the high band of the residual spectrum such that the spectral harmonics structure does not break. Further, second layer encoding section 108 encodes filter information of the pitch filter. Furthermore, second layer encoding section 108 estimates the high band of the residual spectrum using the residual spectrum where the spectrum is flattened. For this reason, when the high band is estimated by repeatedly using the spectrum recursively by filtering processing, it is possible to prevent discontinuity in spectral energy. In this way, according to this embodiment, it is possible to realize high speech quality at a low bit rate. Further, second layer encoding section 108 will be described in details later.

Multiplexing section 109 generates a bit stream by multiplexing the first layer encoded data, the second layer encoded data and the LPC coefficient encoded data, and outputs the bit stream.

Figure 7:
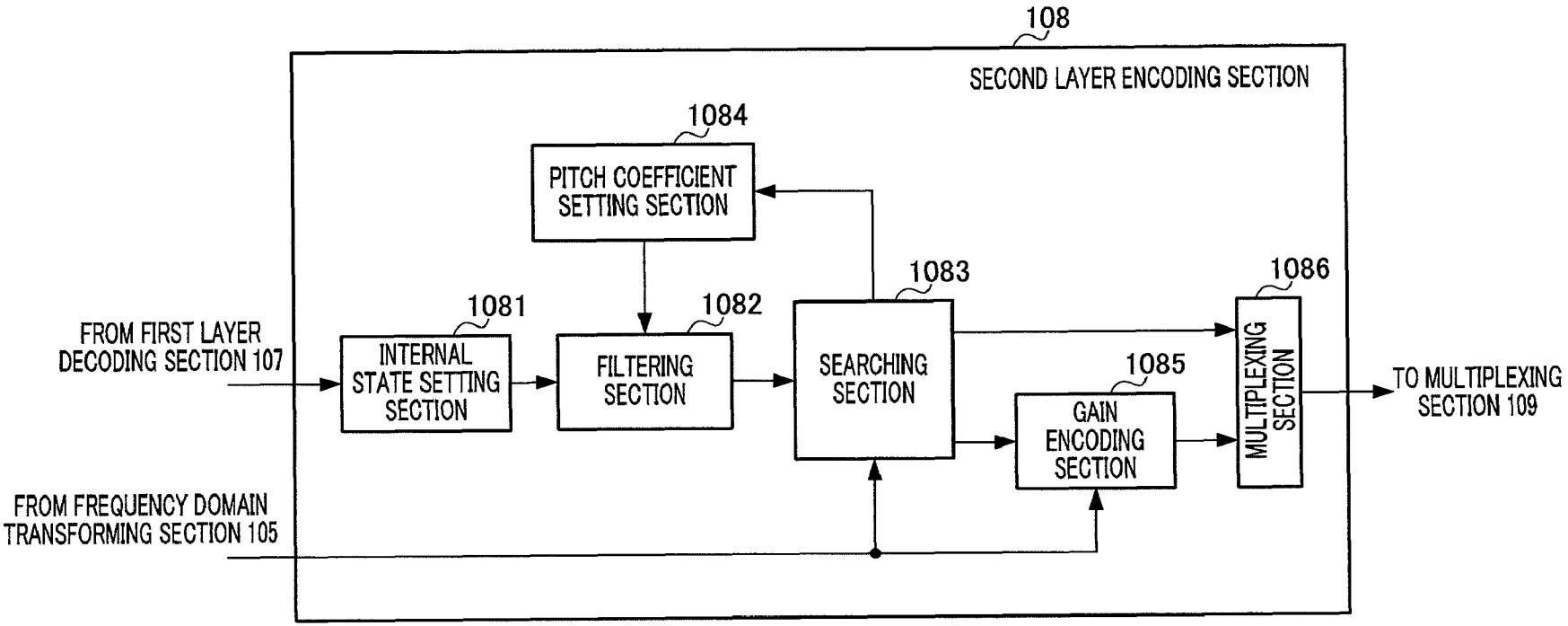
FIG. 7 is a block configuration diagram showing a second layer encoding section of the above speech encoding apparatus.

Next, second layer encoding section 108 will be described in details later. FIG. 7 shows the configuration of second layer encoding section 108.

Internal state setting section 1081 receives an input of first layer decoded spectrum $S1(k)(0 \leqq k < FL)$ from first layer decoding section 107. Internal state setting section 1081 sets the internal state of a filter used at filtering section 1082 using this first layer decoded spectrum.

Pitch coefficient setting section 1084 outputs pitch coefficient T sequentially to filtering section 1082 according to control by searching section 1083 by changing pitch coefficient T little by little within a predetermined search range of $T_{min}$ to $T_{max}$.

Filtering section 1082 filters the first layer decoded spectrum based, on the internal state of the filter set in internal state setting section 1081 and pitch coefficient T outputted from pitch coefficient setting section 1084, and calculates estimated value $S2'(k)$ of the residual spectrum. This filtering processing will be described in details later.

Searching section 1083 calculates a similarity, which is a parameter representing the similarity of residual spectrum S2($k$)(0≦k<FH) inputted from frequency domain transforming section 105 and estimated value S2'($k$) inputted from filtering section 1082. This similarity calculation processing is carried out every time pitch coefficient T is given from pitch coefficient setting section 1084, and pitch coefficient (optimum coefficient) T' (within the range of $T_{min}$ to $T_{max}$) that maximizes the calculated similarity, is outputted to multiplexing section 1086. Further, searching section 1083 outputs estimated value S2'($k$) of the residual spectrum generated by using this pitch coefficient T' to gain encoding section 1085.

Gain encoding section 1085 calculates gain information of residual spectrum S2($k$) based on residual spectrum S2($k$) (0≦k<FH) inputted from frequency domain transforming section 105. Further, a case will be described here as an example where this gain information is represented by spectral power of each subband and frequency band FL≦k<FH is divided into J subbands. Then, spectral power B(j) of the j-th subband is represented by equation 5. In equation 5, BL(j) is the minimum frequency of the j-th subband and BH(j) is the maximum frequency of the j-th subband. Subband information of the residual spectrum determined in this way is regarded as gain information.

(Equation 5)

$$B(j) = \sum_{k=BL(j)}^{BH(j)} S2(k)^2 \quad [5]$$

Further, in the same way, gain encoding section 1085 calculates subband information B'(j) of estimated value S2'($k$) of the residual spectrum according to equation 6, and calculates the amount of fluctuation V(j) on a per subband basis according to equation 7.

(Equation 6)

$$B'(j) = \sum_{k=BL(j)}^{BH(j)} S2'(k)^2 \quad [6]$$

(Equation 7)

$$V(j) = \sqrt{\frac{B(j)}{B'(j)}} \quad [7]$$

Next, gain encoding section 1085 finds the amount of fluctuation $V_q$(j) after encoding the amount of fluctuation V(j) and outputs an index to multiplexing section 1086.

Multiplexing section 1086 multiplexes optimum pitch coefficient T' inputted from searching section 1083 with the index of the amount of fluctuation V(j) inputted from gain encoding section 1085, and outputs the result as the second layer encoded data to multiplexing section 109.

Figure 8:
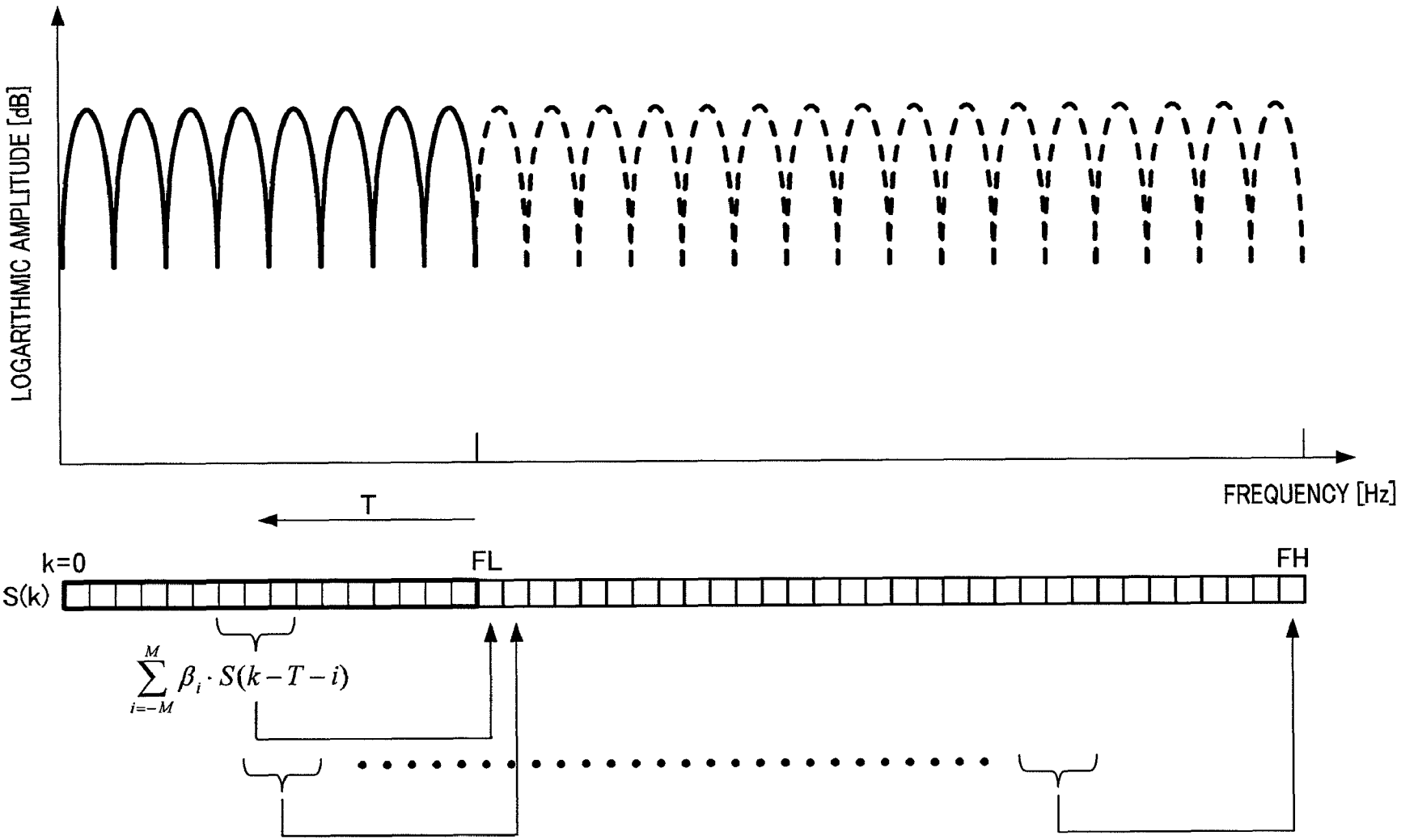
FIG. 8 illustrates operation of a filtering section according to Embodiment 1 of the present invention.

Next, filtering processing at filtering section 1082 will be described in details. FIG. 8 shows how a spectrum of band FL≦k<FH is generated using pitch coefficient T inputted from pitch coefficient setting section 1084. Here, the spectrum of the entire frequency band (0≦k<FH) is referred to as "S(k)" for ease of description and the filter function represented by equation 8 is used. In this equation, T is the pitch coefficient given by pitch coefficient setting section 1084, and M is 1.

(Equation 8)

$$P(z) = \frac{1}{1 - \sum_{i=-M}^{M} \beta_i z^{-T+i}} \quad [8]$$

In band 0≦k<FL of S(k), first layer decoded spectrum S1($k$) is stored as the internal state of the filter. On the other hand, in band FL≦k<FH of S(k) estimated value S2'($k$) of the residual spectrum determined in the following steps is stored.

The spectrum obtained by adding all spectral values $\beta_i$·S (k−T−i) obtained by multiplying neighborhood spectral values S(k−T−i), which is spaced apart by from spectrum S(k−T) of the frequency lowered by T from k as the center, by predetermined weighting coefficient $\beta_i$, that is, the spectrum represented by equation 9, is given for S2'($k$) by filtering processing. Then, this operation is carried out by changing k from the lowest frequency (k=FL) within the range of FL≦k<FH, and, consequently, estimated value S2'($k$) of the residual spectrum within the range of FL≦k<FH is calculated.

(Equation 9)

$$S2'(k) = \sum_{i=-1}^{1} \beta_i \cdot S(k - T - i) \quad [9]$$

In the above filtering processing, every time pitch coefficient T is given from pitch coefficient setting section 1084, S(k) is subjected to zero clear within the range of FL≦k<FH. That is, every time pitch coefficient T changes, S(k) is calculated and outputted to searching section 1083.

Here, in the example shown in FIG. 8, the value of pitch coefficient T is smaller than band FL to FH, and so a high band spectrum (FL≦k<FH) is generated by using a low band spectrum (0≦k<FL) recursively. The low band spectrum is flattened as described above, and so, even when the high band spectrum is generated by recursively using the low band spectrum by filtering processing, discontinuity in high band spectrum energy does not occur.

In this way, according to this embodiment, it is possible to prevent discontinuity in spectral energy which occurs in the high band due to the influence of the spectral envelope, and improve speech quality.

Figure 9:
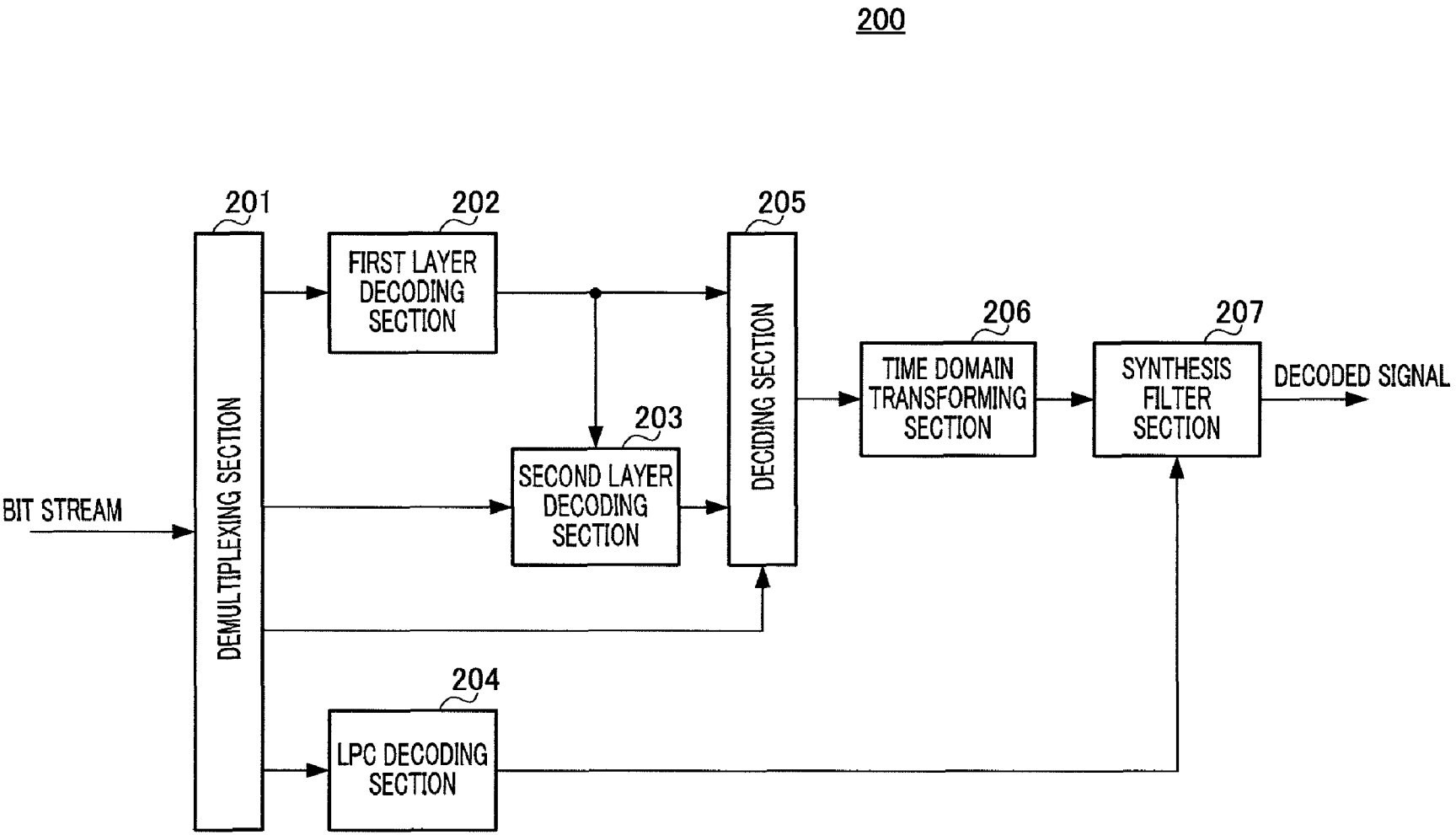
FIG. 9 is a block configuration diagram showing a speech decoding apparatus according to Embodiment 1 of the present invention.

Next, the speech decoding apparatus according to this embodiment will be described. FIG. 9 shows the configuration of the speech decoding apparatus according to Embodiment 1 of the present invention. This speech decoding apparatus 200 receives a bit stream transmitted from speech encoding apparatus 100 shown in FIG. 6.

In speech decoding apparatus 200 shown in FIG. 9, demultiplexing section 201 demultiplexes the bit stream received from speech encoding apparatus 100 shown in FIG. 6, to the first layer encoded data, the second layer encoded data and the LPC coefficient encoded data, and outputs the first layer encoded data to first layer decoding section 202, the second layer encoded data to second layer decoding section 203 and the LPC coefficient encoded data to LPC decoding section 204. Further, demultiplexing section 201 outputs layer information (i.e. information showing which bit stream includes encoded data of which layer) to deciding section 205.

First layer decoding section 202 generates the first layer decoded spectrum by carrying out decoding processing using the first layer encoded data, and outputs the first layer decoded spectrum to second layer decoding section 203 and deciding section 205.

Second layer decoding section 203 generates the second layer decoded spectrum using the second layer encoded data and the first layer decoded spectrum, and outputs the second layer decoded spectrum to deciding section 205. Further, second layer decoding section 203 will be described in details later.

LPC decoding section 204 outputs the decoded LPC coefficients obtained by decoding LPC coefficient encoded data, to synthesis filter section 207.

Here, although speech encoding apparatus 100 transmits the bit stream including both the first layer encoded data and the second layer encoded data, cases occur where the second layer encoded data is discarded at anywhere in the transmission path. Then, deciding section 205 decides whether or not the second layer encoded data is included in the bit stream based on layer information. Further, when the second layer encoded data is not included in the bit stream, second layer decoding section 203 does not generate the second layer decoded spectrum, and so deciding section 205 outputs the first layer decoded spectrum to time domain transforming section 206. However, in this case, to match the order with a decoded spectrum of when the second layer encoded data is included, deciding section 205 extends the order of the first layer decoded spectrum to FH and outputs the spectrum of FL to FH as "zero." On the other hand, when the first layer encoded data and the second layer encoded data are both included in the bit stream, deciding section 205 outputs the second layer decoded spectrum to time domain transforming section 206.

Time domain transforming section 206 generates a decoded residual signal by transforming the decoded spectrum inputted from deciding section 205, to a time domain signal and outputs the signal to synthesis filter section 207.

Synthesis filter section 207 forms a synthesis filter using the decoded LPC coefficients $\alpha_q(i)(1 \leqq i < NP)$ inputted from LPC decoding section 204.

Synthesis filter H(z) is represented by equation 10 or equation 11. Further, in equation 11, $\gamma(0<\gamma<1)$ is a resonance suppression coefficient.

(Equation 10)

$$H(z) = \frac{1}{1 + \sum_{i=1}^{NP} \alpha_q(i) \cdot z^{-i}} \quad [10]$$

(Equation 11)

$$H(z) = \frac{1}{1 + \sum_{i=1}^{NP} \alpha_q(i) \cdot \gamma^i \cdot z^{-i}} \quad [11]$$

Further, by inputting the decoded residual signal given at time domain transforming section 206 as $e_q(n)$ to synthesis filter 207, when a synthesis filter represented by equation 10 is used, decoded signal $s_q(n)$ outputted is represented by equation 12.

(Equation 12)

$$s_q(n) = e_q(n) - \sum_{i=1}^{NP} \alpha_q(i) \cdot s_q(n-i) \quad [12]$$

Similarly, when a synthesis filter represented by equation 11 is used, decoded signal $s_q(n)$ is represented by equation 13.

(Equation 13)

$$s_q(n) = e_q(n) - \sum_{i=1}^{NP} \alpha_q(i) \cdot \gamma^i \cdot s_q(n-i) \quad [13]$$

Figure 10:
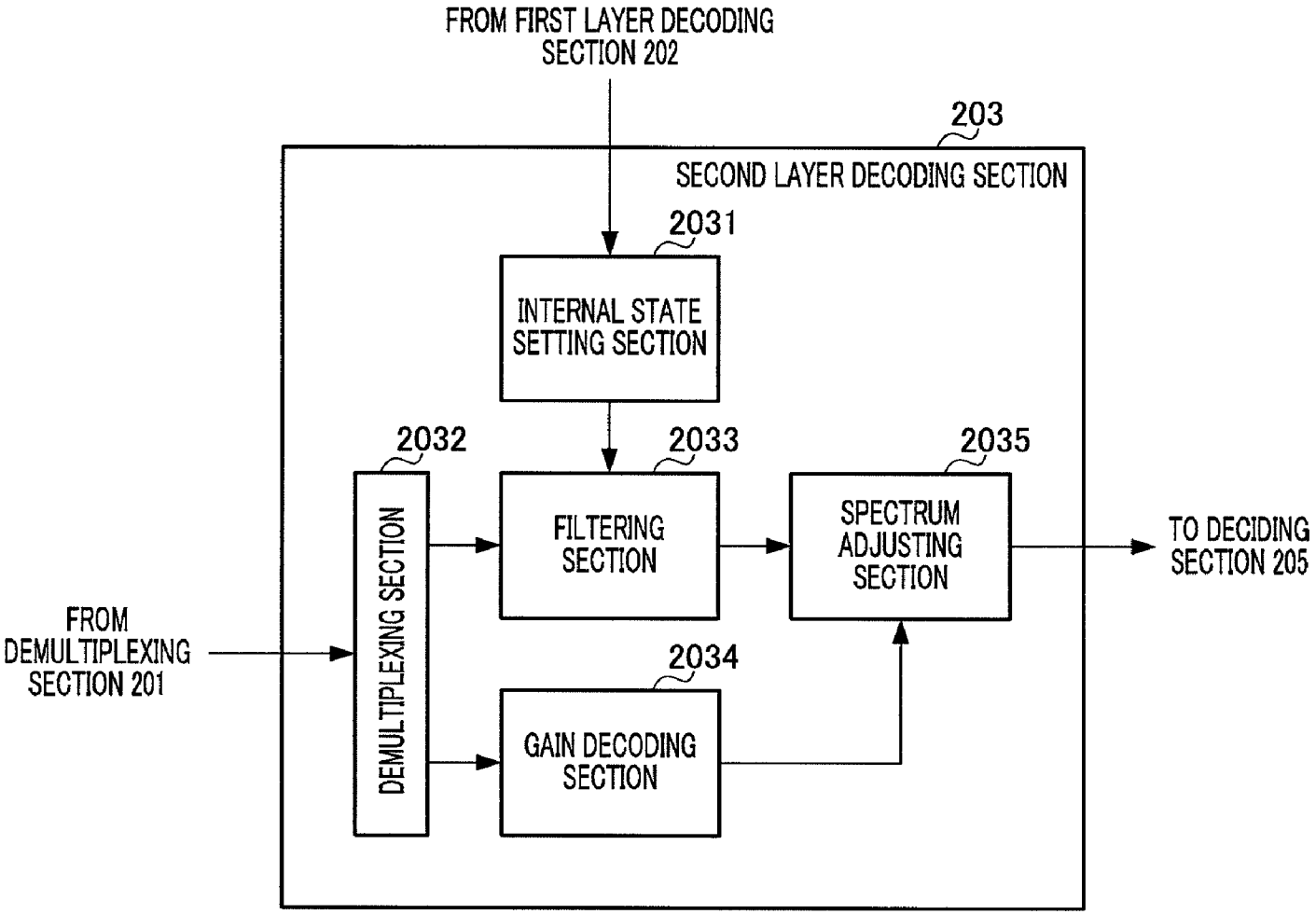
FIG. 10 is a block configuration diagram showing a second layer decoding section of the above speech decoding apparatus.

Next, second layer decoding section 203 will be described in details. FIG. 10 shows the configuration of second layer decoding section 203.

Internal state setting section 2031 receives an input of the first layer decoded spectrum from first layer decoding section 202. Internal state setting section 2031 sets the internal state of the filter used at filtering section 2033 by using first layer decoded spectrum S1(*k*).

On the other hand, demultiplexing section 2032 receives an input of the second layer encoded data from multiplexing section 201. Demultiplexing section 2032 demultiplexes the second layer encoded data to information related to the filtering coefficient (optimum pitch coefficient T') and information related to the gain (the index of the amount of fluctuation V(j)), and outputs information related to the filtering coefficient to filtering section 2033 and information related to the gain to gain decoding section 2034.

Filtering section 2033 filters first layer decoded spectrum S1(*k*) based on the internal state of the filter set at internal state setting section 2031 and pitch coefficient T' inputted from demultiplexing section 2032, and calculates estimated value S2'(*k*) of the residual spectrum. The filter function shown in equation 8 is used in filtering section 2033.

Gain decoding section 2034 decodes gain information inputted from demultiplexing section 2032 and finds the amount of fluctuation $V_q(j)$ obtained by encoding the amount of fluctuation V(j).

Spectrum adjusting section 2035 adjusts the spectral shape of frequency band $FL \leqq k < FH$ of decoded spectrum S'(k) by multiplying according to equation 14 decoded spectrum S'(k) inputted from filtering section 2033 by the decoded amount of fluctuation $V_q(j)$ of each subband inputted from gain decoding section 2034, and generates decoded spectrum S3(*k*) after the adjustment. This decoded spectrum S3(*k*) after the adjustment is outputted to deciding section 205 as the second layer decoded spectrum.

(Equation 14)

$$S3(k) = S'(k) \cdot V_q(j) (BL(j) \leqq k \leqq BH(j), \text{for all } j) \quad [14]$$

In this way, speech decoding apparatus 200 is able to decode a bit stream transmitted from speech encoding apparatus 100 shown in FIG. 6.

Embodiment 2

A case will be described here with this embodiment where time domain encoding (for example, CELP encoding) is carried out in the first layer. Further, in this embodiment, the spectrum of the first layer decoded signal is flattened using the decoded LPC coefficients determined during encoding processing in the first layer.

Figure 11:
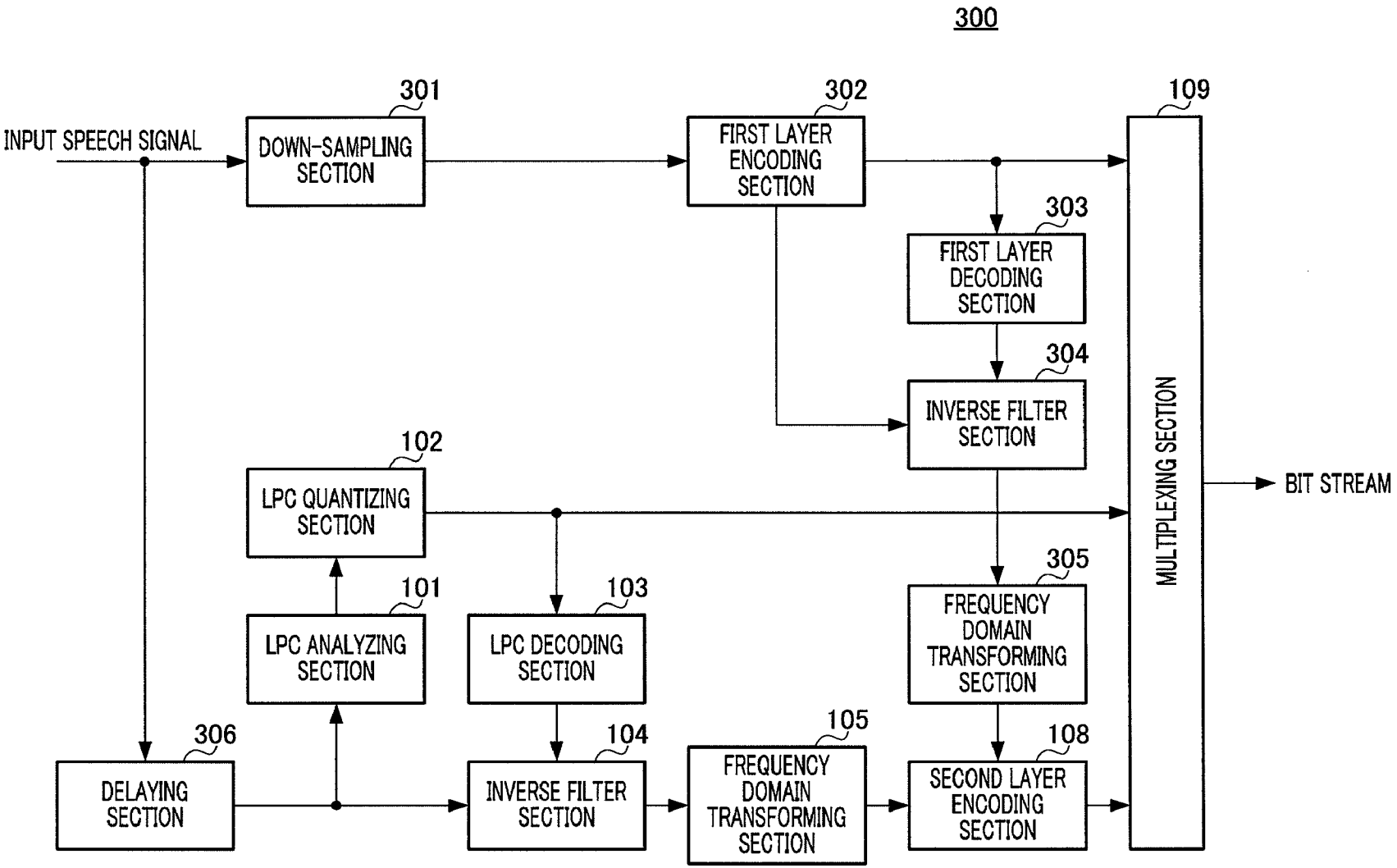
FIG. 11 is a block configuration diagram showing the speech encoding apparatus according to Embodiment 2 of the present invention.

FIG. 11 shows the configuration of the speech encoding apparatus according to Embodiment 2 of the present invention. In FIG. 11, the same components as in Embodiment 1 (FIG. 6) will be assigned the same reference numerals and repetition of description will be omitted.

In speech encoding apparatus 300 shown in FIG. 11, down-sampling section 301 down-samples a sampling rate for an input speech signal and outputs a speech signal of a desired sampling rate to first layer encoding section 302.

First layer encoding section 302 generates the first layer encoded data by encoding the speech signal down-sampled to the desired sampling rate and outputs the first layer encoded data to first layer decoding section 303 and multiplexing section 109. First layer encoding section 302 uses, for example, CELP encoding. When the LPC coefficients are encoded as in CELP encoding, first layer encoding section 302 is able to generate decoded LPC coefficients during this encoding processing. Then, first layer encoding section 302 outputs the first layer decoded LPC coefficients generated during the encoding processing, to inverse filter section 304.

First layer decoding section 303 generates the first layer decoded signal by carrying out decoding processing using the first layer encoded data, and outputs this signal to inverse filter section 304.

Inverse filter section 304 forms an inverse filter using the first layer decoded LPC coefficients inputted from first layer encoding section 302 and flattens the spectrum of the first layer decoded signal by filtering the first layer decoded signal through this inverse filter. Further, details of the inverse filter are the same as in Embodiment 1 and so repetition of description is omitted. Furthermore, in the following description, an output signal of inverse filter section 304 (i.e. the first layer decoded signal where the spectrum is flattened) is referred to as a "first layer decoded residual signal."

Frequency domain transforming section 305 generates the first layer decoded spectrum by carrying out a frequency analysis of the first layer decoded residual signal outputted from inverse filter section 304, and outputs the first layer decoded spectrum to second layer encoding section 108.

Further, delaying section 306 adds the predetermined period of delay to the input speech signal. The amount of this delay takes the same value as the delay time that occurs when the input speech signal passes through down-sampling section 301, first layer encoding section 302, first layer decoding section 303, inverse filter section 304, and frequency domain transforming section 305.

In this way, according to this embodiment, the spectrum of the first layer decoded signal is flattened using the decoded LPC coefficients (first layer decoded LPC coefficients) determined during the encoding processing in the first layer, so that it is possible to flatten the spectrum of the first layer decoded signal using information of first layer encoded data. Consequently, according to this embodiment, the LPC coefficients for flattening the spectrum of the first layer decoded signal do not require encoded bits, so that it is possible to flatten the spectrum without increasing the amount of information.

Figure 12:
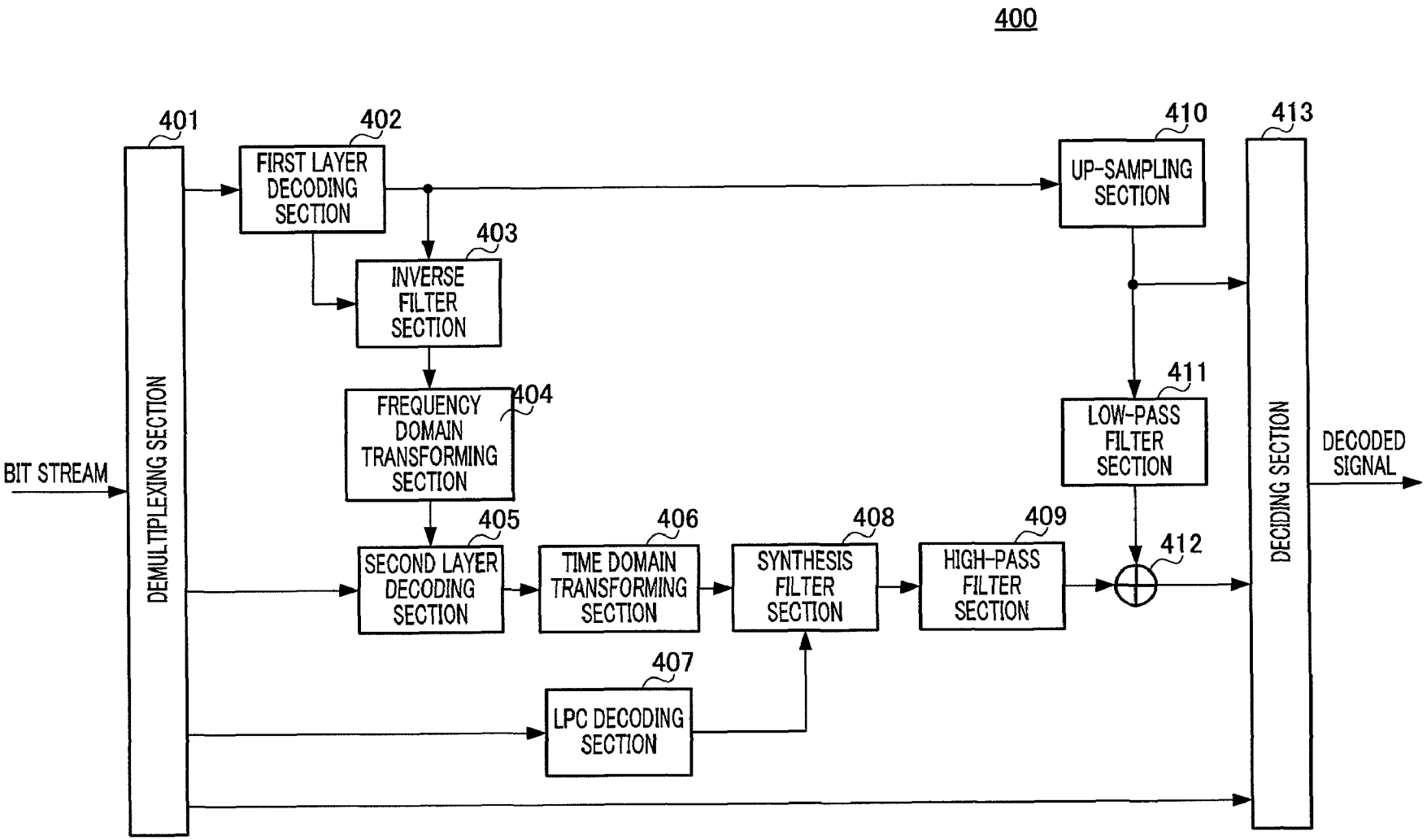
FIG. 12 is a block configuration diagram showing the speech decoding apparatus according to Embodiment 2 of the present invention.

Next, the speech decoding apparatus according to this embodiment will be described. FIG. 12 shows the configuration of the speech decoding apparatus according to Embodiment 2 of the present invention. This speech decoding apparatus 400 receives a bit stream transmitted from speech encoding apparatus 300 shown in FIG. 11.

In speech decoding apparatus 400 shown in FIG. 12, demultiplexing section 401 demultiplexes the bit stream received from speech encoding apparatus 300 shown in FIG. 11, to the first layer encoded data, the second layer encoded data and the LPC coefficient encoded data, and outputs the first layer encoded data to first layer decoding section 402, the second layer encoded data to second layer decoding section 405 and the LPC coefficient encoded data to LPC decoding section 407. Further, demultiplexing section 401 outputs layer information (i.e. information showing which bit stream includes encoded data of which layer) to deciding section 413.

First layer decoding section 402 generates the first layer decoded signal by carrying out decoding processing using the first layer encoded data and outputs the first layer decoded signal to inverse filter section 403 and up-sampling section 410. Further, first layer decoding section 402 outputs the first layer decoded LPC coefficients generated during the decoding processing, to inverse filter section 403.

Up-sampling section 410 up-samples the sampling rate for the first layer decoded signal to the same sampling rate for the input speech signal of FIG. 11, and outputs the first layer decoded signal to low-pass filter section 411 and deciding section 413.

Low-pass filter section 411 sets a pass band of 0 to FL in advance, generates a low band signal by passing the up-sampled first layer decoded signal of frequency band 0 to FL and outputs the low band signal to adding section 412.

Inverse filter section 403 forms an inverse filter using the first layer decoded LPC coefficients inputted from first layer decoding section 402, generates the first layer decoded residual signal by filtering the first layer decoded signal through this inverse filter and outputs the first layer decoded residual signal to frequency domain transforming section 404.

Frequency domain transforming section 404 generates the first layer decoded spectrum by carrying out a frequency analysis of the first layer decoded residual signal outputted from inverse filter section 403 and outputs the first layer decoded spectrum to second layer decoding section 405.

Second layer decoding section 405 generates the second layer decoded spectrum using the second layer encoded data and the first layer decoded spectrum and outputs the second layer decoded spectrum to time domain transforming section 406. Further, details of second layer decoding section 405 are the same as second layer decoding section 203 (FIG. 9) of Embodiment 1 and so repetition of description is omitted.

Time domain transforming section 406 generates the second layer decoded residual signal by transforming the second layer decoded spectrum to a time domain signal and outputs the second layer decoded residual signal to synthesis filter section 408.

LPC decoding section 407 outputs the decoded LPC coefficients obtained by decoding the LPC coefficient encoded data, to synthesis filter section 408.

Synthesis filter section 408 forms a synthesis filter using the decoded LPC coefficients inputted from LPC decoding section 407. Further, details of synthesis filter 408 are the same as synthesis filter section 207 (FIG. 9) of Embodiment 1 and so repetition of description is omitted. Synthesis filter section 408 generates second layer synthesized signal $s_q(n)$ as in Embodiment 1 and outputs this signal to high-pass filter section 409.

High-pass filter section 409 sets the pass band of FL to FH in advance, generates a high band signal by passing the second layer synthesized signal of frequency band FL to FH and outputs the high band signal to adding section 412.

Adding section 412 generates the second layer decoded signal by adding the low band signal and the high band signal and outputs the second layer decoded signal to deciding section 413.

Deciding section 413 decides whether or not the second layer encoded data is included in the bit stream based on layer information inputted from demultiplexing section 401, selects either the first layer decoded signal or the second layer decoded signal, and outputs this signal as a decoded signal. If the second layer encoded data is not included in the bit stream, Deciding section 413 outputs the first layer decoded signal, and, if both the first layer encoded data and the second layer encoded data are included in the bit stream, outputs the second layer decoded signal.

Further, low-pass filter section 411 and high-pass filter section 409 are used to ease the influence of the low band signal and the high band signal upon each other. Consequently, when the influence of the low band signal and the high band signal upon each other is less, a configuration not using these filters may be possible. When these filters are not used, operation according to filtering is not necessary, so that it is possible to reduce the amount of operation.

In this way, speech decoding apparatus 400 is able to decode a bit stream transmitted from speech encoding apparatus 300 shown in FIG. 11.

Embodiment 3

The spectrum of the first layer excitation signal is flattened in the same way as the spectrum of the prediction residual signal where the influence of the spectral envelope is removed from the input speech signal. Then, with this embodiment, the first layer excitation signal determined during encoding processing in the first layer is processed as a signal where the spectrum is flattened (that is, the first layer decoded residual signal of Embodiment 2).

Figure 13:
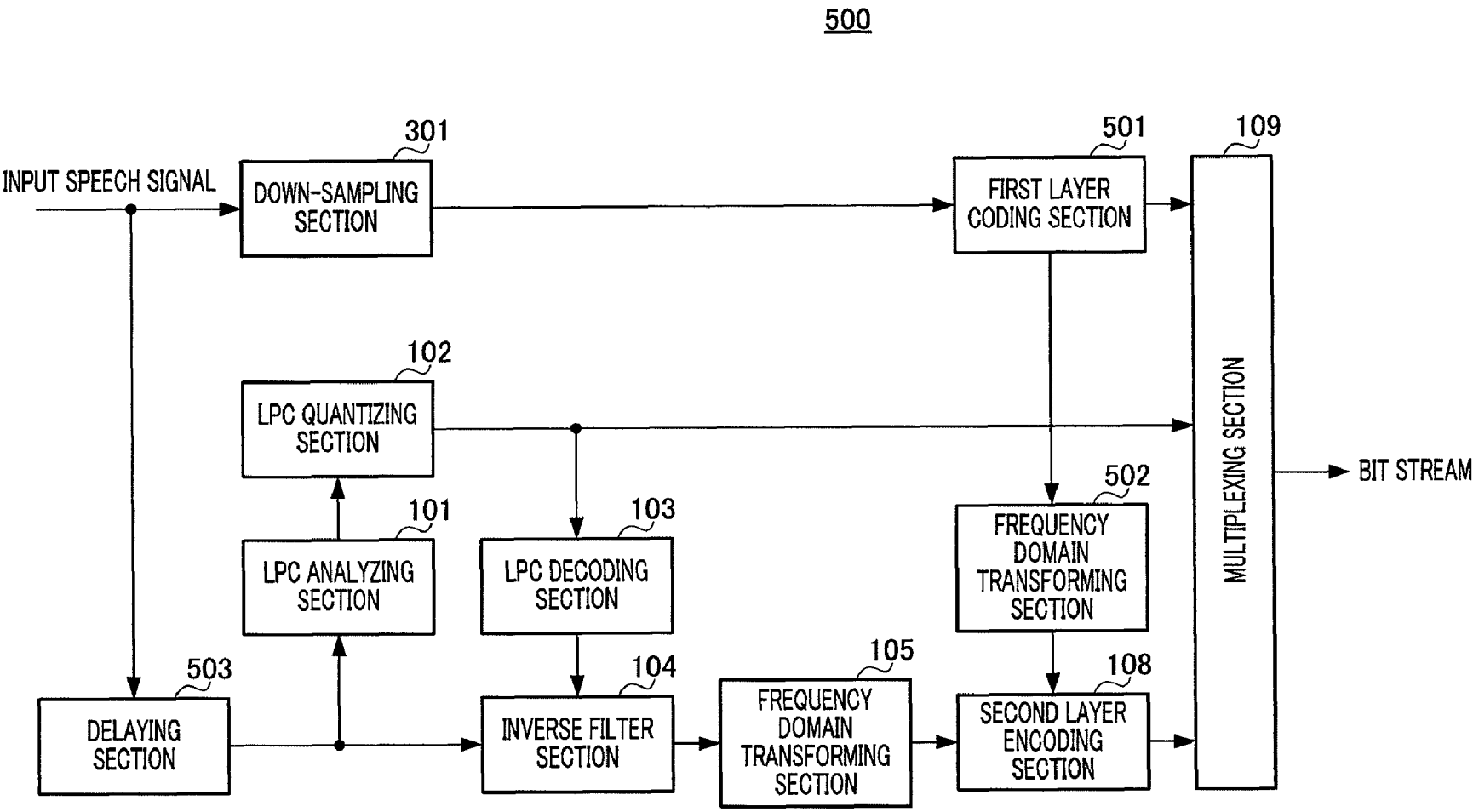
FIG. 13 is a block configuration diagram showing the speech encoding apparatus according to Embodiment 3 of the present invention.

FIG. 13 shows the configuration of the speech encoding apparatus according to Embodiment 3 of the present invention. In FIG. 13, the same components as in Embodiment 2 (FIG. 11) will be assigned the same reference numerals and repetition of description will be omitted.

First layer encoding section 501 generates the first layer encoded data by encoding a speech signal down-sampled to a desired sampling rate, and outputs the first layer encoded data to multiplexing section 109. First layer encoding section 501 uses, for example, CELP encoding. Further, first layer encoding section 501 outputs the first layer excitation signal generated during the encoding processing, to frequency domain transforming section 502. Furthermore, what is referred to as an "excitation signal" here is a signal inputted to a synthesis filter (or perceptual weighting synthesis filter) inside first layer encoding section 501 that carries out CELP encoding, and is also referred to as a "excitation signal."

Frequency domain transforming section 502 generates the first layer decoded spectrum by carrying out a frequency analysis of the first layer excitation signal, and outputs the first layer decoded signal to second layer encoding section 108.

Further, the amount of delay of delaying section 503 takes the same value as the delay time that occurs when the input speech signal passes through down-sampling section 301, first layer encoding section 501, and frequency domain transforming section 502.

In this way, according to this embodiment, first layer decoding section 303 and inverse filter section 304 are not necessary, compared to Embodiment 2 (FIG. 11), so that it is possible to reduce the amount of operation.

Figure 14:
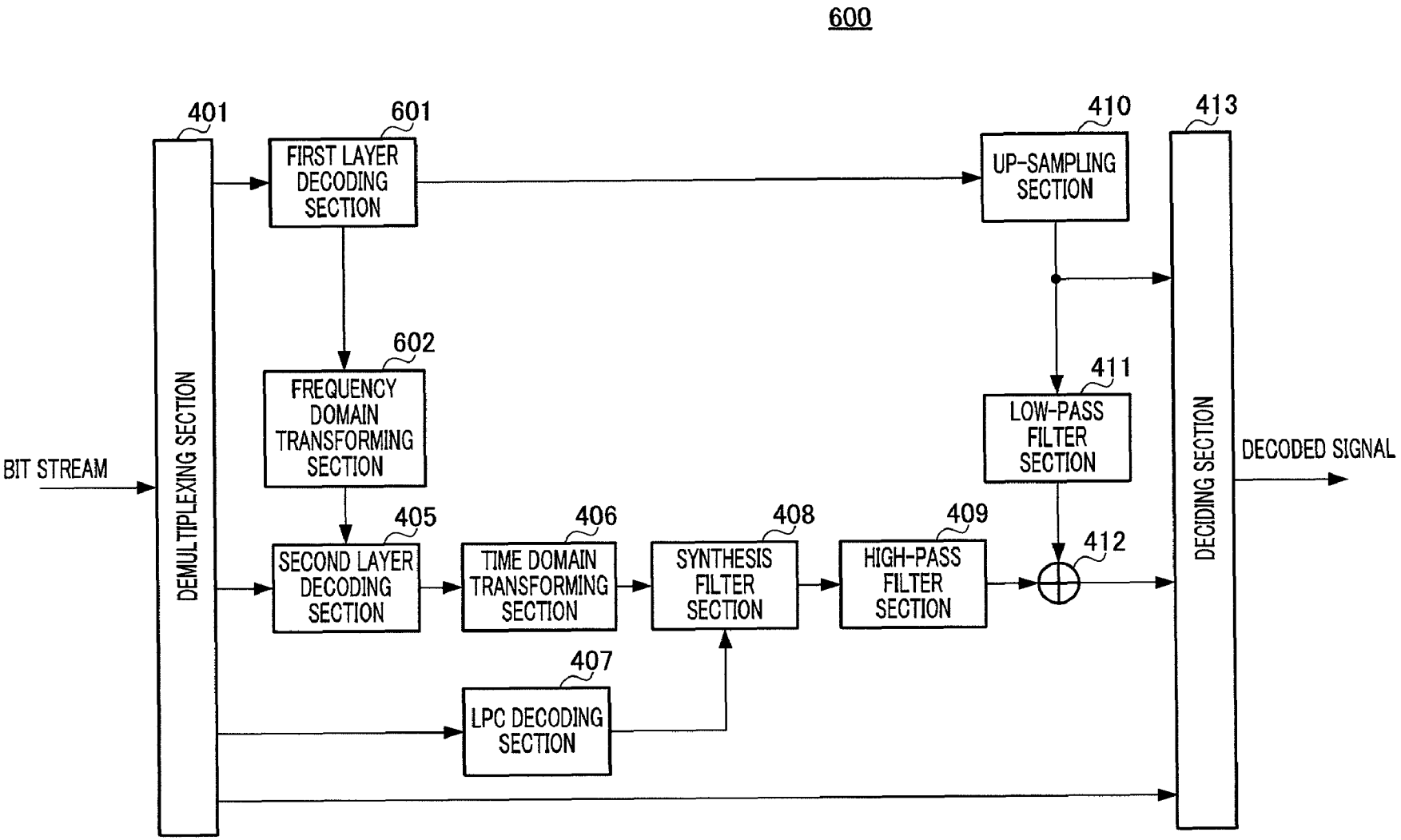
FIG. 14 is a block configuration diagram showing the speech decoding apparatus according to Embodiment 3 of the present invention.

Next, the speech decoding apparatus according to this embodiment will be described. FIG. 14 shows the configuration of the speech decoding apparatus according to Embodiment 3 of the present invention. This speech decoding apparatus 600 receives a bit stream transmitted from speech encoding apparatus 500 shown in FIG. 13. In FIG. 14, the same components as in Embodiment 2 (FIG. 12) will be assigned the same reference numerals and repetition of description will be omitted.

First layer decoding section 601 generates the first layer decoded signal by carrying out decoding processing using the first layer encoded data, and outputs the first layer decoded signal to up-sampling section 410. Further, first layer decoding section 601 outputs the first layer excitation signal generated during decoding processing to frequency domain transforming section 602.

Frequency domain transforming section 602 generates the first layer decoded spectrum by carrying out a frequency analysis of the first layer excitation signal and outputs the first layer decoded spectrum to second layer decoding section 405.

In this way, speech decoding apparatus 600 is able to decode a bit stream transmitted from speech encoding apparatus 500 shown in FIG. 13.

Embodiment 4

In this embodiment, the spectra of the first layer decoded signal and an input speech signal are flattened using the second layer decoded LPC coefficients determined in the second layer.

Figure 15:
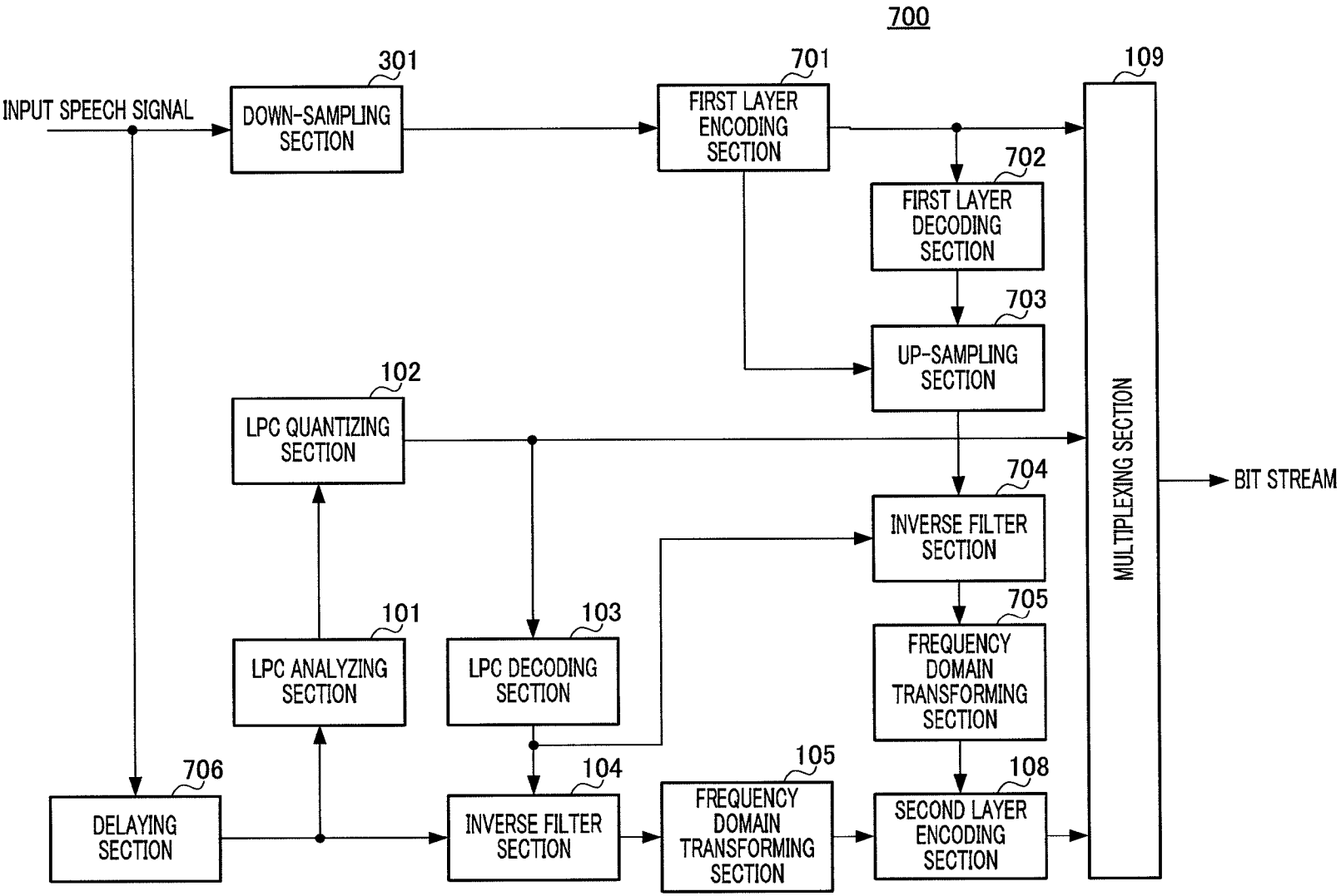
FIG. 15 is a block configuration diagram showing the speech encoding apparatus according to Embodiment 4 of the present invention.

FIG. 15 shows the configuration of the speech encoding apparatus 700 according to Embodiment 4 of the present invention. In FIG. 15, the same components as in Embodiment 2 (FIG. 11) will be assigned the same reference numerals and repetition of description will be omitted.

First layer encoding section 701 generates the first layer encoded data by encoding the speech signal down-sampled to the desired sampling rate and outputs the first layer encoded data to first layer decoding section 702 and multiplexing section 109. First layer encoding section 701 uses, for example, CELP encoding.

First layer decoding section 702 generates the first layer decoded signal by carrying out decoding processing using the first layer encoded data and outputs this signal to up-sampling section 703.

Up-sampling section 703 up-samples a sampling rate for the first layer decoded signal to the same sampling rate for the input speech signal, and outputs the first layer decoded signal to inverse filter section 704.

Similar to inverse filter section 104, inverse filter section 704 receives the decoded LPC coefficients from LPC decoding section 103. Inverse filter section 704 forms an inverse filter using the decoded LPC coefficients and flattens the spectrum of the first layer decoded signal by filtering the up-sampled first layer decoded signal through this inverse filter. Further, in the following description, an output signal of inverse filter section 704 (first layer decoded signal where the spectrum is flattened) is referred to as the "first layer decoded residual signal."

Frequency domain transforming section 705 generates the first layer decoded spectrum by carrying out a frequency analysis of the first layer decoded residual signal outputted from inverse filter section 704 and outputs the first layer decoded spectrum to second layer encoding section 108.

Further, the amount of delay of delaying section 706 takes the same value as the delay time that occurs when the input speech signal passes through down-sampling section 301, first layer encoding section 701, first layer decoding section 702, up-sampling section 703, inverse filter section 704, and frequency domain transforming section 705.

Figure 16:
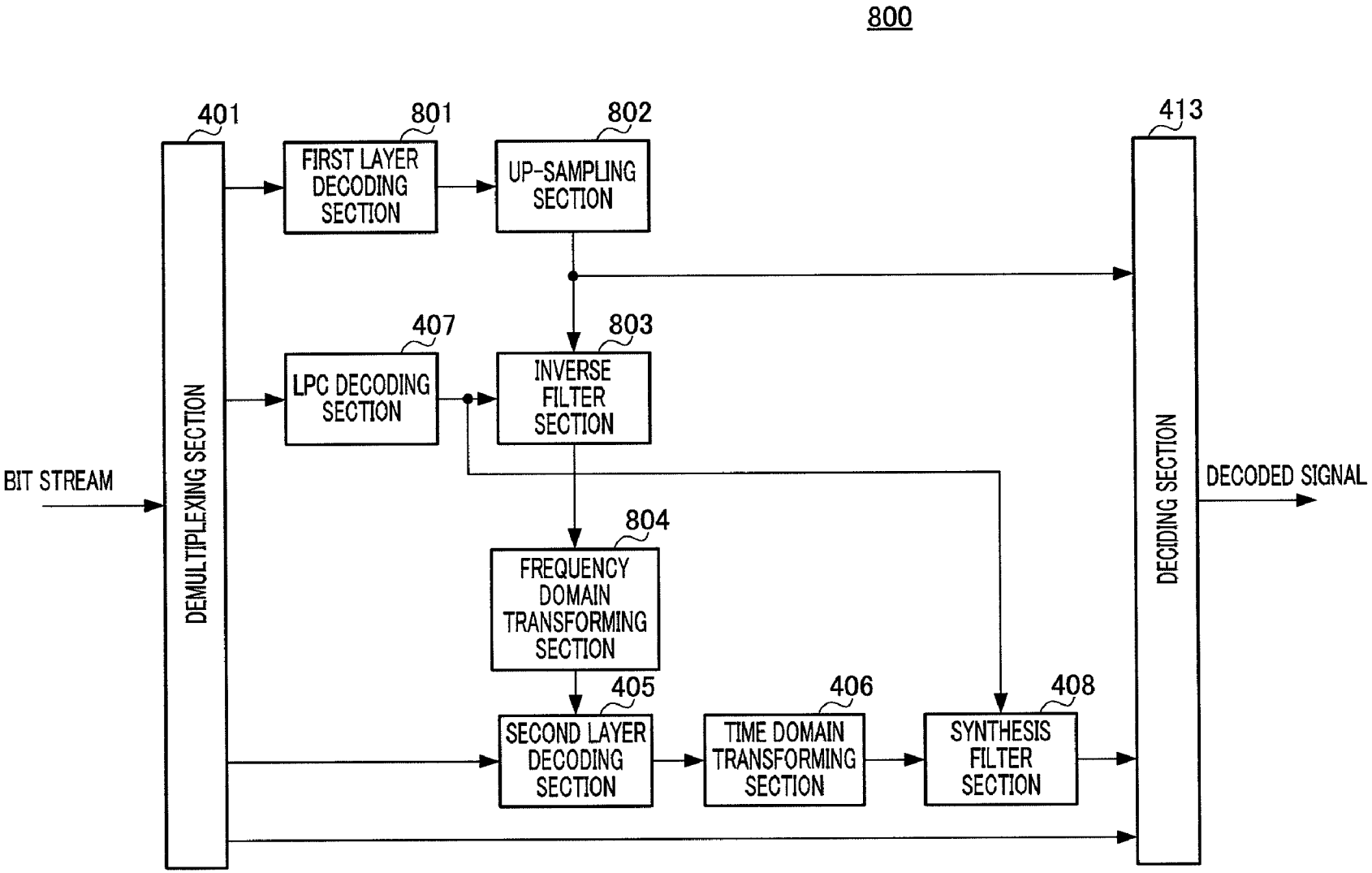
FIG. 16 is a block configuration diagram showing the speech decoding apparatus according to Embodiment 4 of the present invention.

Next, the speech decoding apparatus according to this embodiment will be described. FIG. 16 shows the configuration of the speech decoding apparatus according to Embodiment 4 of the present invention. This speech decoding apparatus 800 receives a bit stream transmitted from speech encoding apparatus 700 shown in FIG. 15. In FIG. 16, the same components as in Embodiment 2 (FIG. 12) will be assigned the same reference numerals and repetition of description will be omitted.

First layer decoding section 801 generates the first layer decoded signal by carrying out decoding processing using the first layer encoded data and outputs this signal to up-sampling section 802.

Up-sampling section 802 up-samples the sampling rate for the first layer decoded signal to the same sampling rate for the input speech signal of FIG. 15, and outputs the first layer decoded signal to inverse filter section 803 and deciding section 413.

Similar to synthesis filter section 408, inverse filter section 803 receives the decoded LPC coefficients from LPC decoding section 407. Inverse filter section 803 forms an inverse filter using the decoded LPC coefficients, flattens the spectrum of the first layer decoded signal by filtering the up-sampled first layer decoded signal through this inverse filter, and outputs the first layer decoded residual signal to frequency domain transforming section 804.

Frequency domain transforming section 804 generates the first layer decoded spectrum by carrying out a frequency analysis of the first layer decoded residual signal outputted from inverse filter section 803 and outputs the first layer decoded spectrum to second layer decoding section 405.

In this way, speech decoding apparatus 800 is able to decode a bit stream transmitted from speech encoding apparatus 700 shown in FIG. 15.

In this way, according to this embodiment, the speech encoding apparatus flattens the spectra of the first layer decoded signal and an input speech signal using the second layer decoded LPC coefficients determined in the second layer, so that it is possible to find the first layer decoded spectrum using LPC coefficients that are common between the speech decoding apparatus and the speech encoding apparatus. Therefore, according to this embodiment, when the speech decoding apparatus generates a decoded signal, separate processing for the low band and the high band as described in Embodiments 2 and 3 is no longer necessary, so that a low-pass filter and a high-pass filter are not necessary, a configuration of an apparatus becomes simple and it is possible to reduce the amount of operation of filtering processing.

Embodiment 5

In this embodiment, the degree of flattening is controlled by adaptively changing a resonance suppression coefficient of an inverse filter for flattening a spectrum, according to characteristics of an input speech signal.

Figure 17:
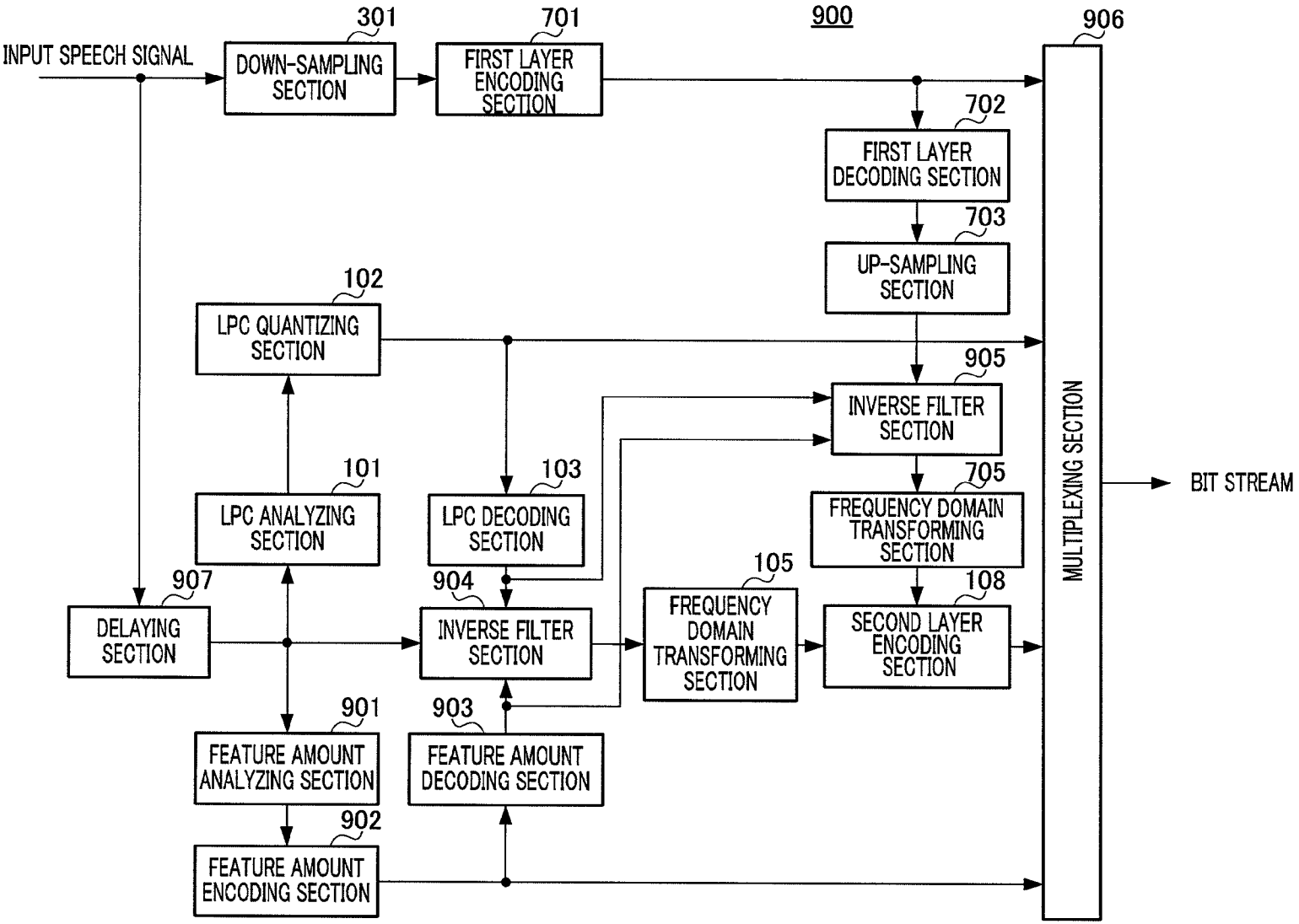
FIG. 17 is a block configuration diagram showing the speech encoding apparatus according to Embodiment 5 of the present invention.

FIG. 17 shows the configuration of speech encoding apparatus 900 according to Embodiment 5 of the present invention. In FIG. 17, the same components as in Embodiment 4 (FIG. 15) will be assigned the same reference numerals and repetition of description will be omitted.

In speech encoding apparatus 900, inverse filter sections 904 and 905 are represented by equation 2.

Feature amount analyzing section 901 calculates the amount of feature by analyzing the input speech signal, and outputs the amount of feature to feature amount encoding section 902. As the amount of feature, a parameter representing the intensity of a speech spectrum with respect to resonance is used. To be more specific, for example, the distance between adjacent LSP parameters is used. Generally, when this distance is shorter, the degree of resonance is stronger and the energy of the spectrum corresponding to the resonance frequency is greater. In a speech period where resonance is stronger, the spectrum is attenuated too much in the neighborhood of the resonance frequency, and so speech quality deteriorates. To prevent this, the degree of flattening is set little by setting above resonance suppression coefficient $\gamma(0<\gamma<1)$ little in a speech period where resonance is stronger. By this means, it is possible to prevent excessive spectrum attenuation in the neighborhood of the resonance frequency by flattening processing and prevent speech quality deterioration.

Feature amount encoding section 902 generates feature amount encoded data by encoding the amount of feature inputted from feature amount analyzing section 901 and outputs the feature amount encoded data to feature amount decoding section 903 and multiplexing section 906.

Feature amount decoding section 903 decodes the amount of feature using feature amount encoded data, determines resonance suppression coefficient $\gamma$ used at inverse filter sections 904 and 905 according to the decoding amount of feature and outputs resonance suppression coefficient $\gamma$ to inverse filter sections 904 and 905. When a parameter representing the degree of the periodicity is used as the amount of feature, resonance suppression coefficient $\gamma$ is set greater if the periodicity of an input speech signal is greater, and resonance suppression coefficient $\gamma$ is set smaller if the periodicity of the input signal is less. By controlling resonance suppression coefficient $\gamma$ in this way, the degree of flattening the spectrum is greater in the voiced part, and is less in the unvoiced part. In this way, it is possible to prevent excessive spectrum flattening in the unvoiced part and prevent speech quality deterioration.

Inverse filter sections 904 and 905 carry out inverse filter processing based on resonance suppression coefficient $\gamma$ controlled at feature amount decoding section 903 according to equation 2.

Multiplexing section 906 generates a bit stream by multiplexing the first layer encoded data, the second layer encoded data, the LPC coefficient encoded data and the feature amount encoded data, and outputs the bit stream.

Further, the amount of delay of delaying section 907 takes the same value as the delay time that occurs when the input speech signal passes through down-sampling section 301, first layer encoding section 701, first layer decoding section 702, up-sampling section 703, inverse filter section 905 and frequency domain transforming section 705.

Figure 1:
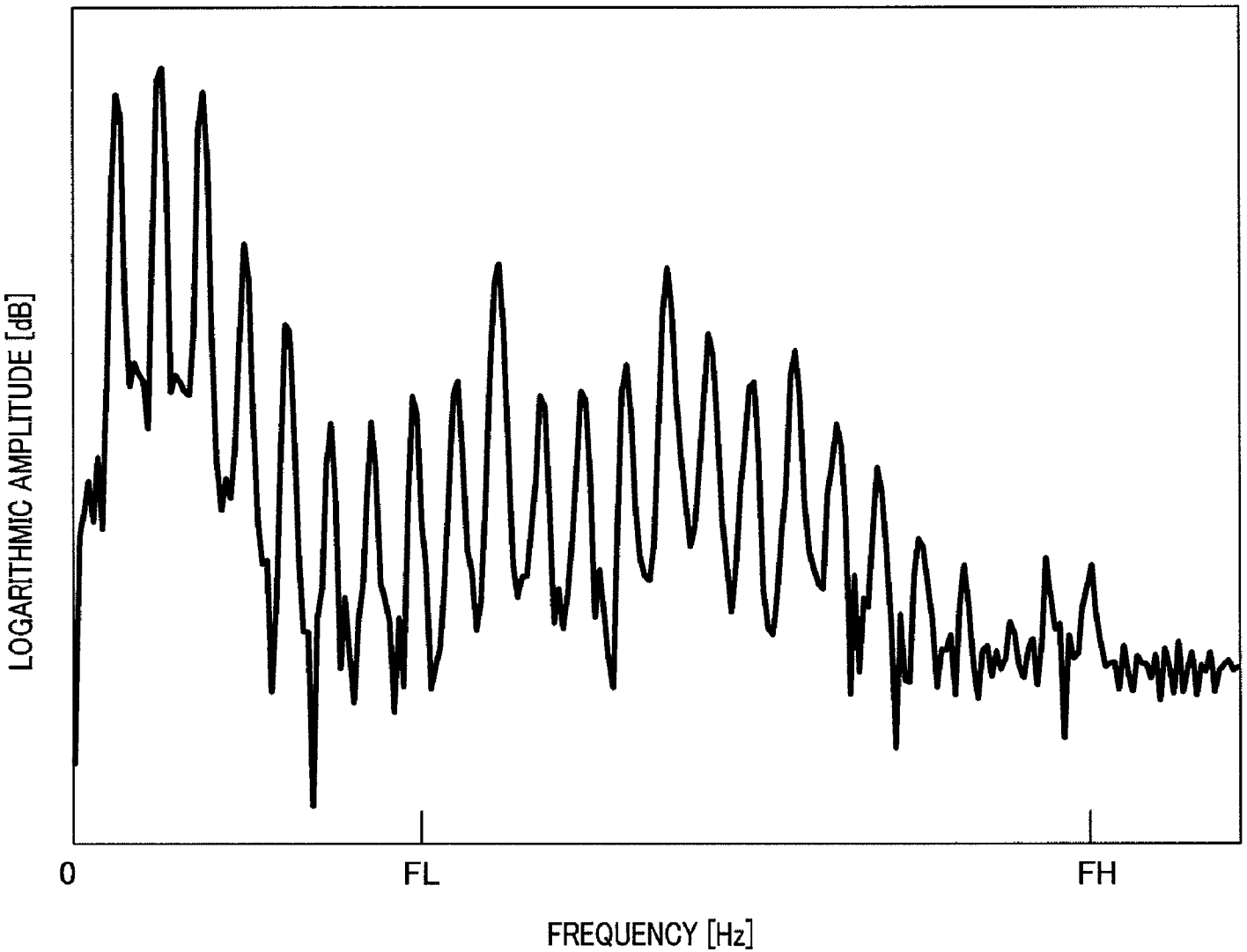
FIG. 1 shows a (conventional) spectrum of a speech signal.
Figure 2:
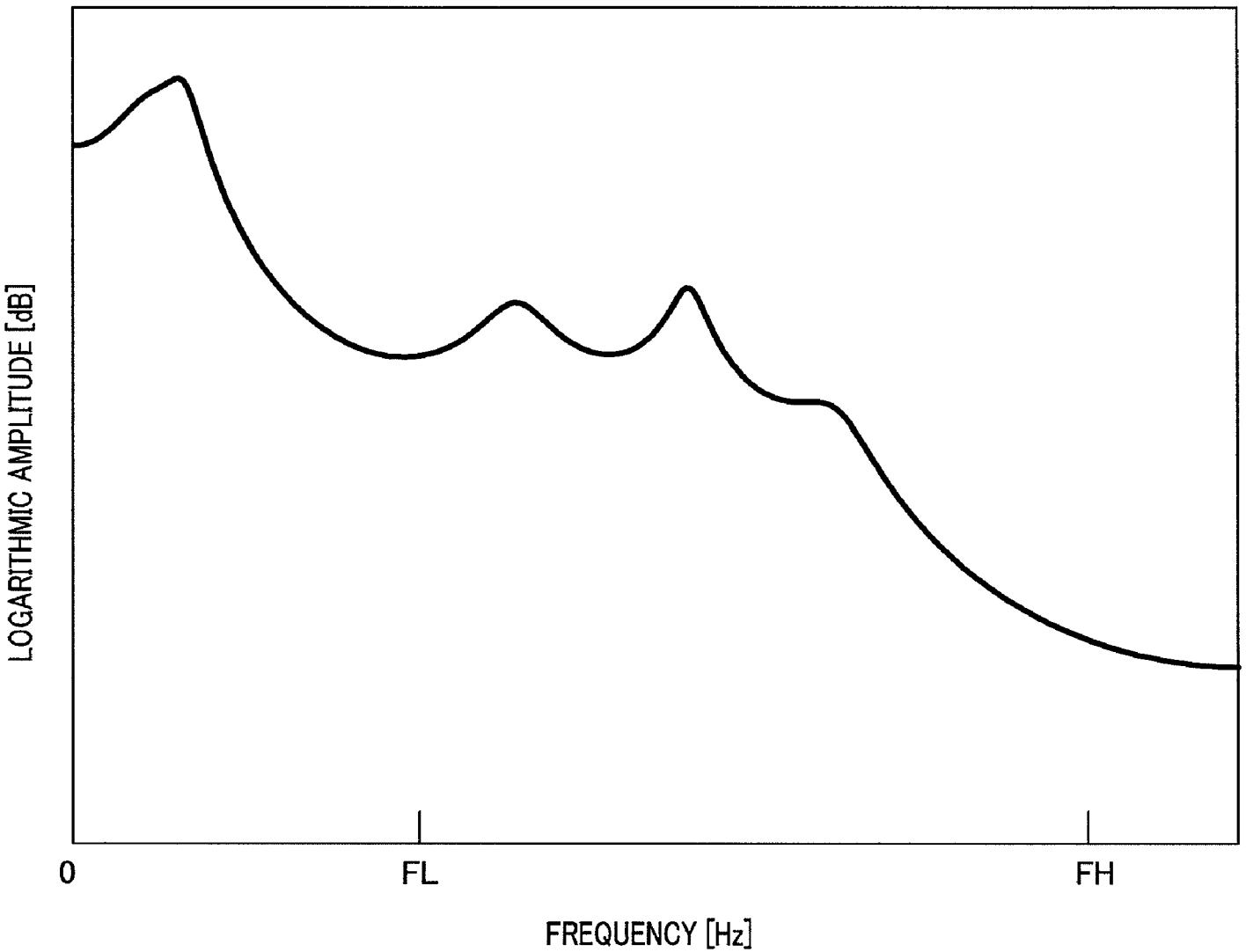
FIG. 2 shows a (conventional) spectral envelope.
Figure 3:
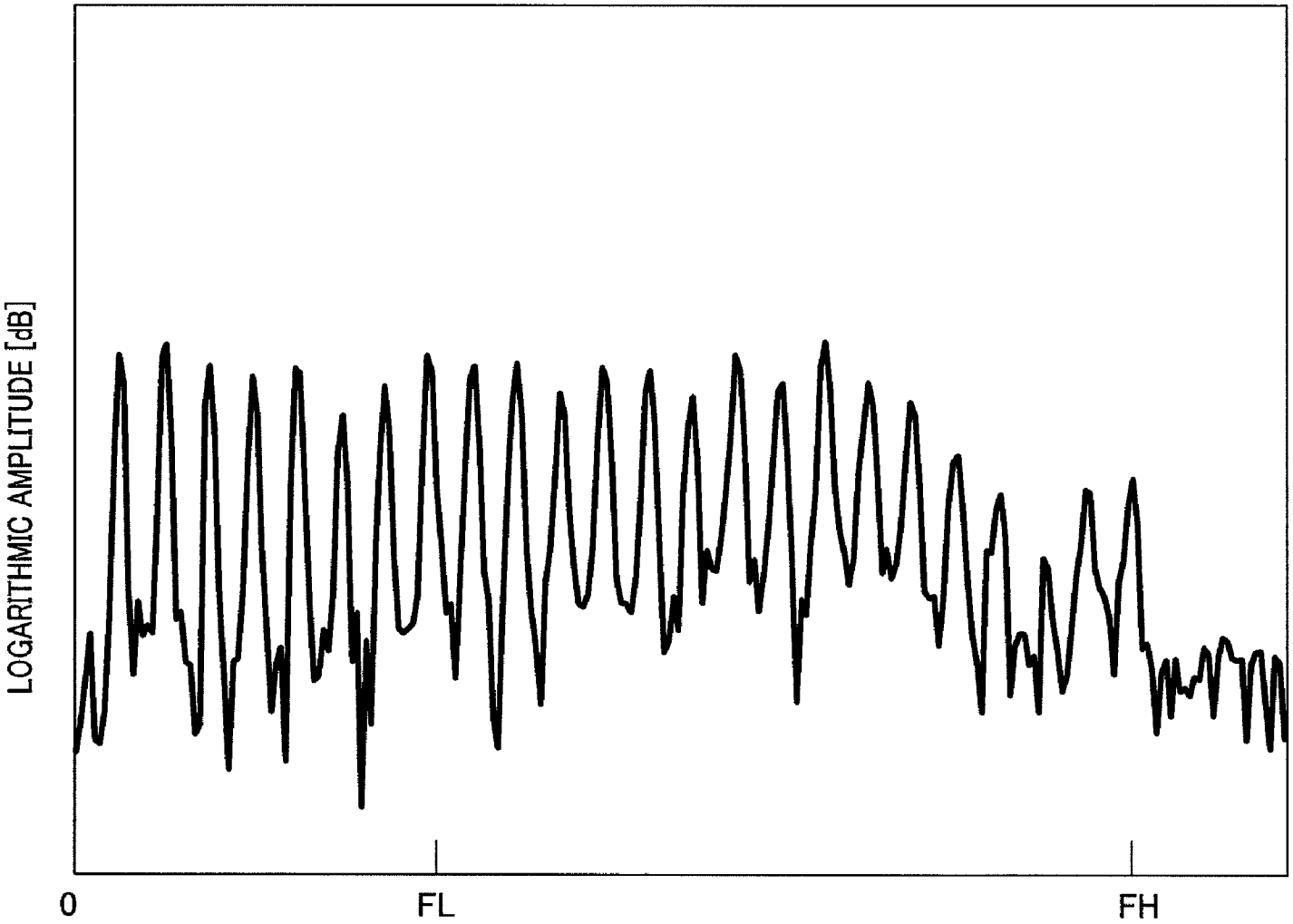
FIG. 3 shows a (conventional) spectral fine structure.
Figure 4:
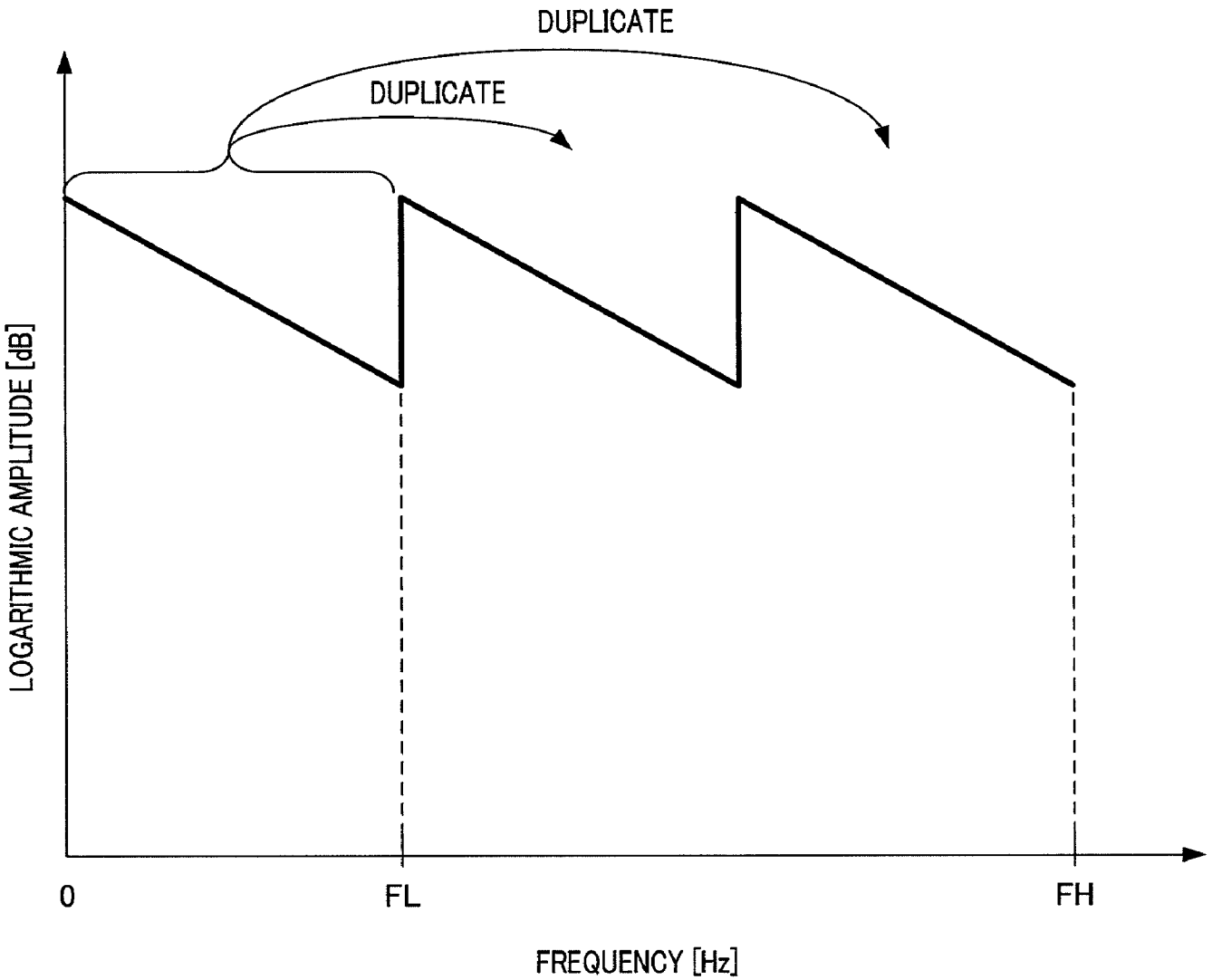
FIG. 4 shows the (conventional) spectrum when the low band spectrum is duplicated to the high band a plurality of times.
Figure 18:
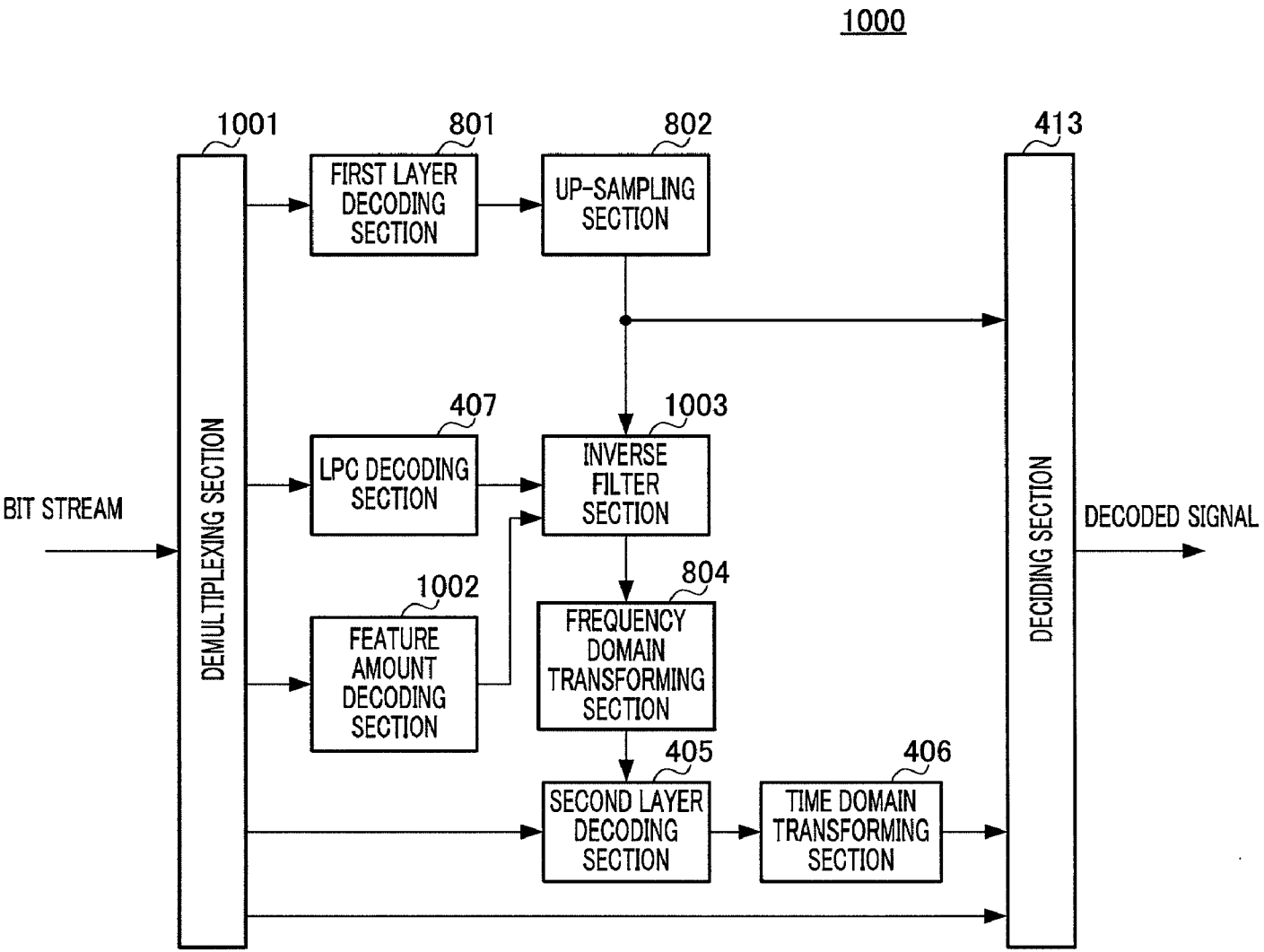
FIG. 18 is a block configuration diagram showing the speech decoding apparatus according to Embodiment 5 of the present invention.

Next, the speech decoding apparatus according to this embodiment will be described. FIG. 18 shows the configuration of the speech decoding apparatus according to Embodiment 5 of the present invention. This speech decoding apparatus 1000 receives a bit stream transmitted from speech encoding apparatus 900 shown in FIG. 17. In FIG. 18, the same components as in Embodiment 4 (FIG. 1G) will be assigned the same reference numerals and repetition of description will be omitted.

In speech encoding apparatus 1000, inverse filter section 1003 is represented by equation 2.

Demultiplexing section 1001 demultiplexes the bit stream received from speech encoding apparatus 900 shown in FIG. 17, to the first layer encoded data, the second layer encoded data, the LPC coefficient encoded data and the feature amount encoded data, and outputs the first layer encoded data to first layer decoding section 801, the second layer encoded data to second layer decoding section 405, the LPC coefficient encoded data to LPC decoding section 407 and the feature amount encoded data to feature amount decoding section 1002. Further, demultiplexing section 1001 outputs layer information (i.e. information showing which bit stream includes encoded data of which layer) is outputted to deciding section 413.

Similar to feature amount decoding section 903 (FIG. 17), feature amount decoding section 1002 decodes the amount of feature using the feature amount encoded data, determines resonance suppression coefficient γ used at inverse filter section 1003 according to the decoding amount of feature and outputs resonance suppression coefficient γ to inverse filter section 1003.

Inverse filter section 1003 carries out inverse filtering processing based on resonance suppression coefficient γ controlled at feature amount decoding section 1002 according to equation 2.

In this way, speech decoding apparatus 1000 is able to decode a bit stream transmitted from speech encoding apparatus 900 shown in FIG. 17.

Figure 19:
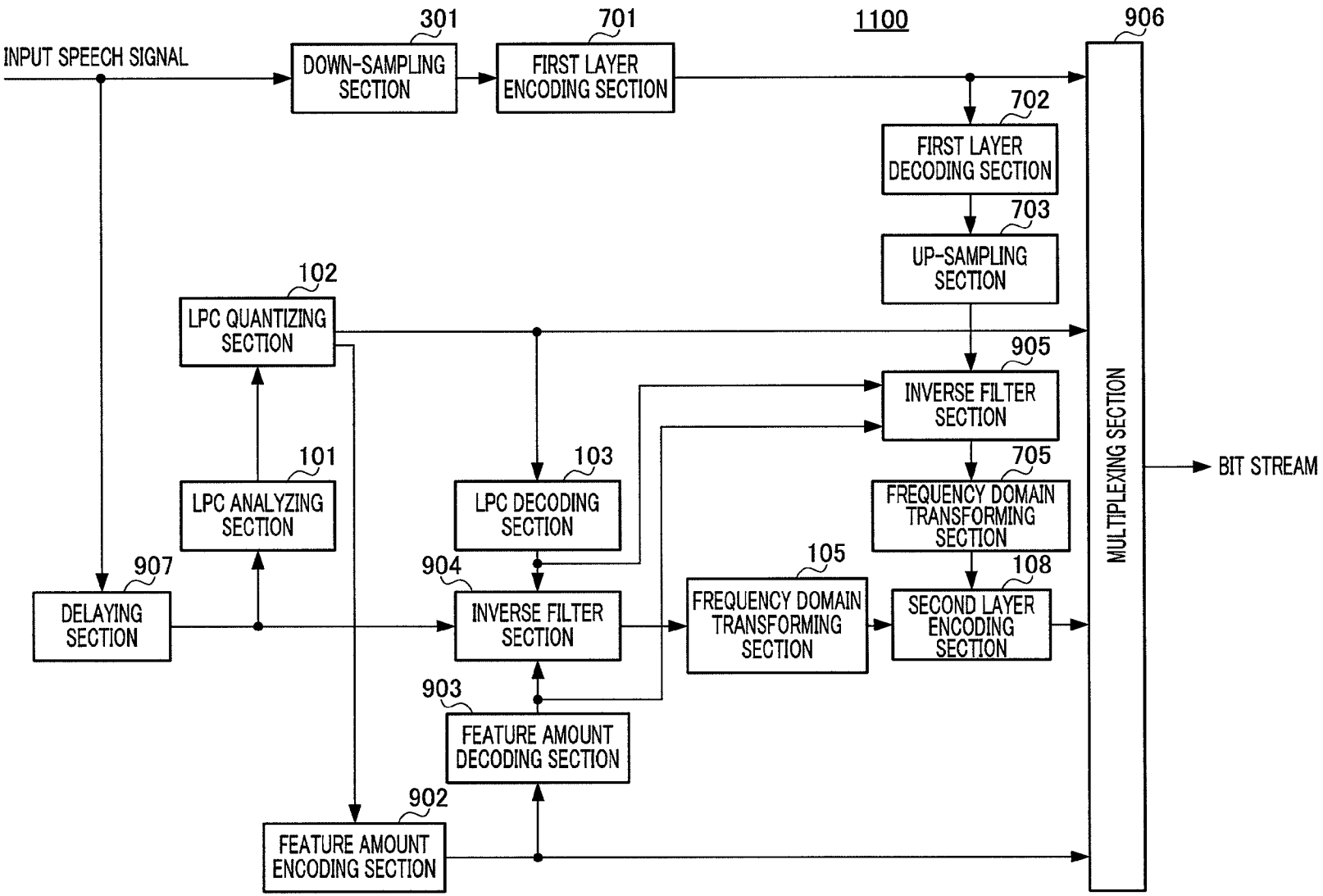
FIG. 19 is a block configuration diagram showing the speech encoding apparatus according to Embodiment 5 of the present invention (modified example 1)

Further, as described above, LPC quantizing section 102 (FIG. 17) converts the LPC coefficients to LSP parameters first and quantizes the LSP parameters. Then, in this embodiment, a configuration of the speech encoding apparatus may be as shown in FIG. 19. That is, in speech encoding apparatus 1100 shown in FIG. 19, feature amount analyzing section 901 is not provided, and LPC quantizing section 102 calculates the distance between LSP parameters and outputs the distance to feature amount encoding section 902.

Figure 20:
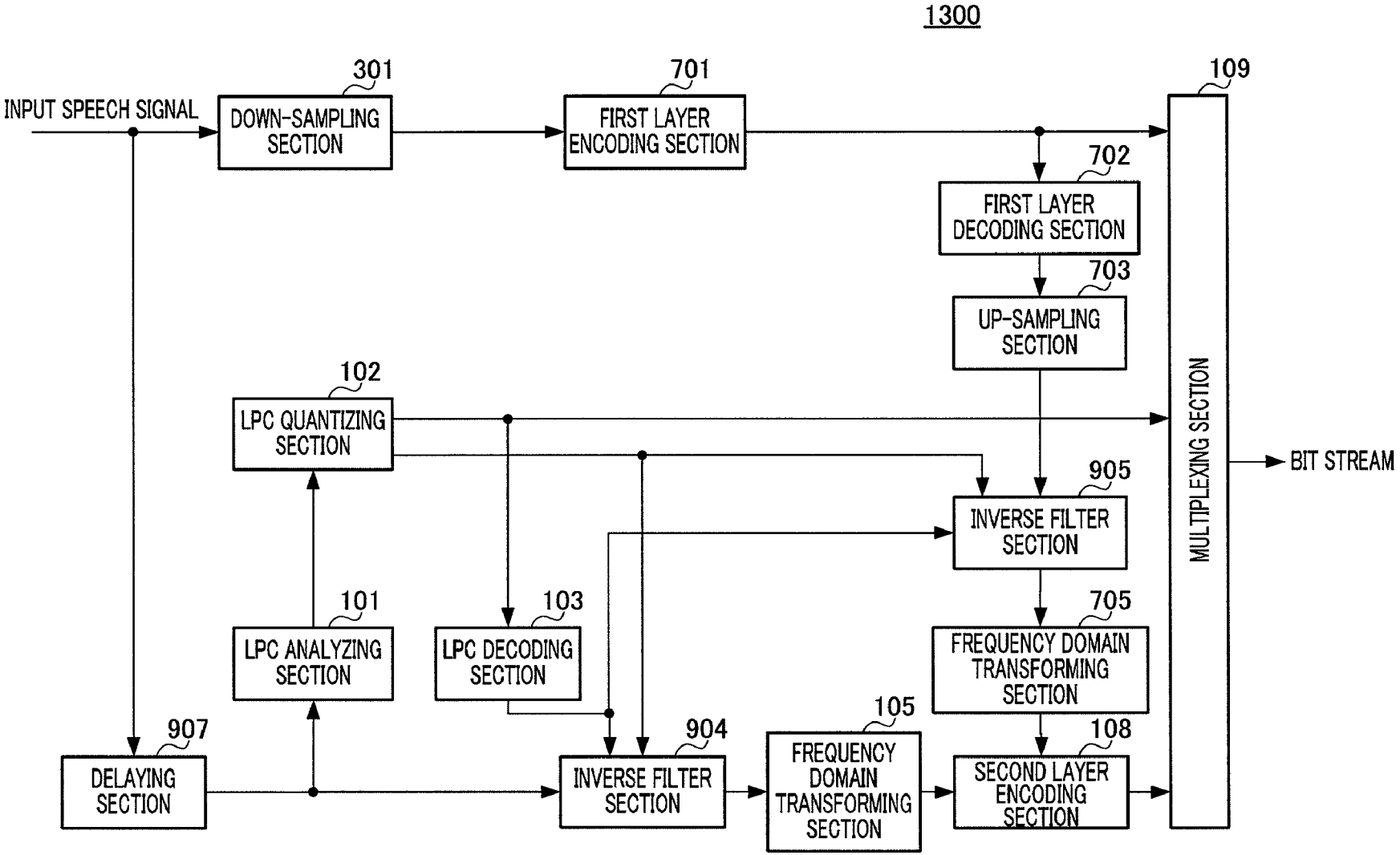
FIG. 20 is a block configuration diagram showing the speech encoding apparatus according to Embodiment 5 of the present invention (modified example 2)

Further, when LPC quantizing section 102 generates decoded LSP parameters, the configuration of the speech encoding apparatus may be as shown in FIG. 20. That is, in speech encoding apparatus 1300 shown in FIG. 20, feature amount analyzing section 901, feature amount encoding section 902 and feature amount decoding section 903 are not provided, and LPC quantizing section 102 generates the decoded LSP parameters, calculates the distance between the decoded LSP parameters and outputs the distance to inverse filter section 904 and 905.

Figure 21:
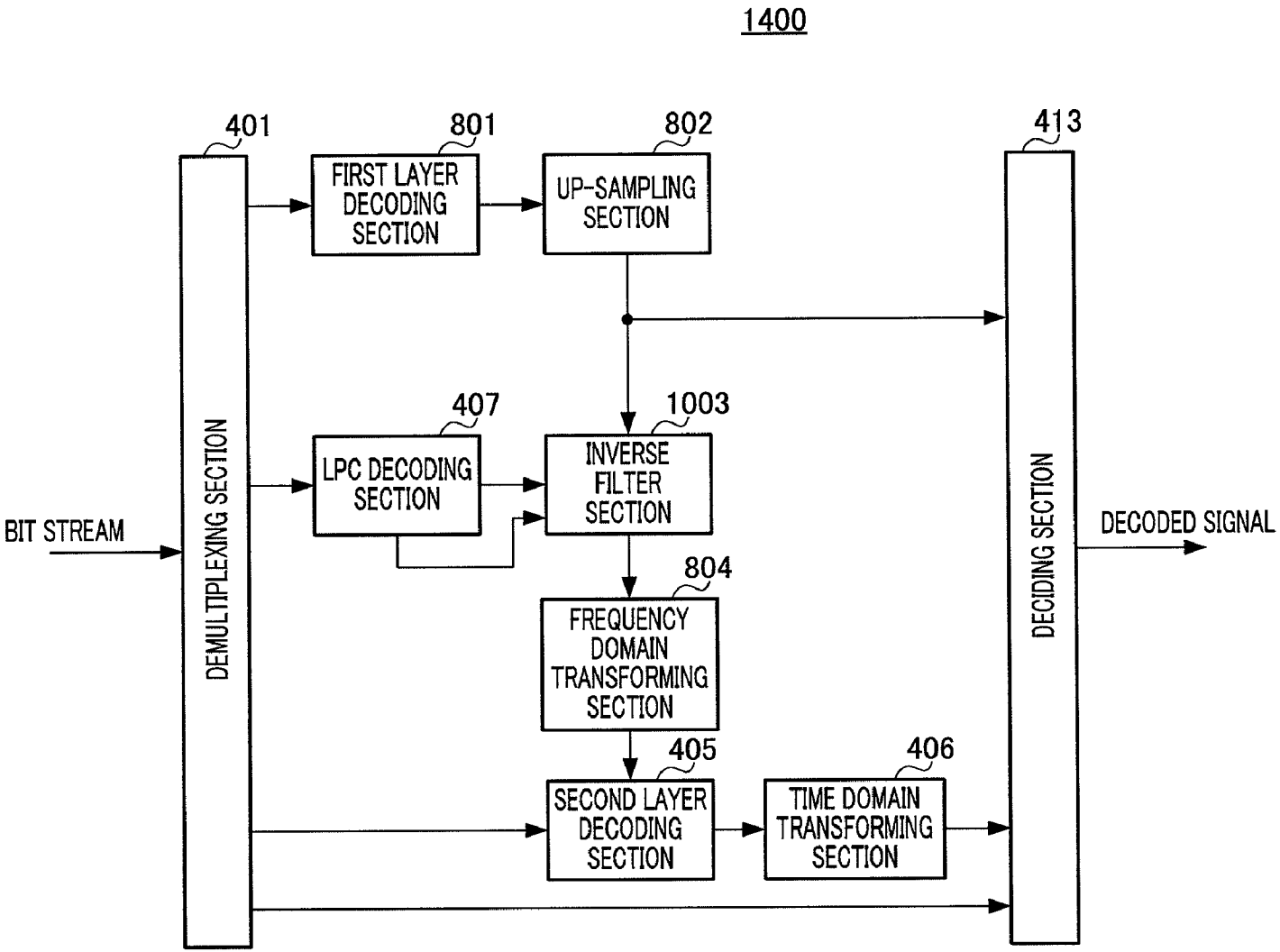
FIG. 21 is a block configuration diagram showing the speech decoding apparatus according to Embodiment 5 of the present invention (modified example 1)

Further, FIG. 21 shows the configuration of speech decoding apparatus 1400 that decodes a bit stream transmitted from speech encoding apparatus 1300 shown in FIG. 20. In FIG. 21, LPC decoding section 407 further calculates the distance between the decoded LSP parameters and outputs the distance to inverse filter section 1003.

Embodiment 6

With speech signals or audio signals, cases frequently occur where the dynamic range (i.e. the ratio of the maximum value of the amplitude of the spectrum, to the minimum value) of a low band spectrum, which is the duplication source, becomes larger than the dynamic range of a high band spectrum, which is the duplication destination. Under such a circumstance, when the low band spectrum is duplicated to obtain the high band spectrum, an undesirable peak in the high band spectrum occurs. Then, in the decoded signal obtained by transforming the spectrum with such an undesirable peak, to the time domain, noise that sounds like tinkling of a bell occurs, and, consequently, subjective quality deteriorates.

In contrast with this, to improve subjective quality, a technique is proposed for modifying a low band spectrum and adjusting the dynamic range of the low band spectrum closer to the dynamic range of the high band spectrum (for example, see "Improvement of the super-wideband scalable coder using pitch filtering based on spectrum coding," Oshikiri, Ehara, and Yoshida, 2004 Autumnal Acoustic Society Paper Collection 2-4-13, pp. 297 to 298, September 2004). With this technique, it is necessary to transmit modification information showing how the low band spectrum is modified, from the speech encoding apparatus to the speech decoding apparatus.

Here, when this modification information is encoded in the speech encoding apparatus, if the number of encoding candidates is not sufficient, that is, if the bit rate is low, a large quantization error occurs. Then, if such a large quantization error occurs, the dynamic range of the low band spectrum is not sufficiently adjusted due to the quantization error, and, as a result, quality deterioration occurs. Particularly, when an encoding candidate showing a dynamic range larger than the dynamic range of the high band spectrum is selected, an undesirable peak in the high band spectrum is likely to occur and cases occur where quality deterioration shows remarkably.

Then, according to this embodiment, in a case where the technique for adjusting the dynamic range of the low band spectrum closer to the dynamic range of the high band, is applied to the above embodiments, when second layer encoding section 108 encodes modification information, an encoding candidate that decreases a dynamic range is more likely to be selected than an encoding candidate that increases a dynamic range.

Figure 22:
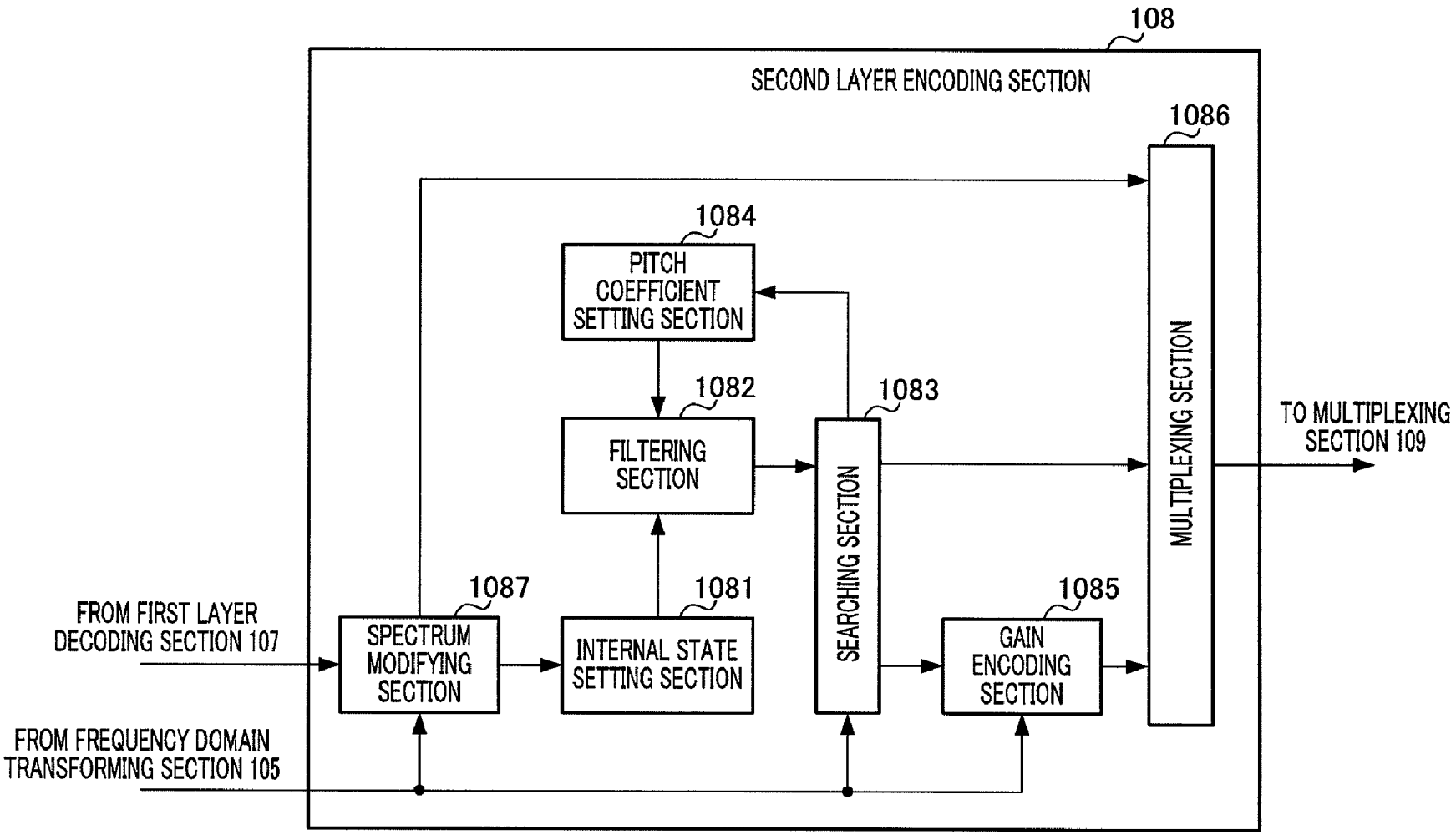
FIG. 22 is a block configuration diagram showing the second layer encoding section according to Embodiment 6 of the present invention.

FIG. 22 shows the configuration of second layer encoding section 108 according to Embodiment 6 of the present invention. In FIG. 22, the same components as in Embodiment 1 (FIG. 7) will be assigned the same reference numerals and repetition of description will be omitted.

In second layer encoding section 108 shown in FIG. 22, spectrum modifying section 1087 receives an input of first layer decoded spectrum S1(*k*) ($0 \leqq k < FL$) from first layer decoding section 107 and an input of residual spectrum S2(*k*) ($0 \leqq k < FH$) from frequency domain transforming section 105. Spectrum modifying section 1087 changes the dynamic range of decoded spectrum S1(*k*) by modifying decoded spectrum S1(*k*) such that the dynamic range of decoded spectrum S1(*k*) is adjusted to an adequate dynamic range. Then, spectrum modifying section 1087 encodes modification information showing how decoded spectrum S1(*k*) is modified, and outputs encoded modification information to multiplexing section 1086. Further, spectrum modifying section 1087 outputs modified decoded spectrum (modified decoded spectrum) S1'(*j, k*) to internal state setting section 1081.

Figure 23:
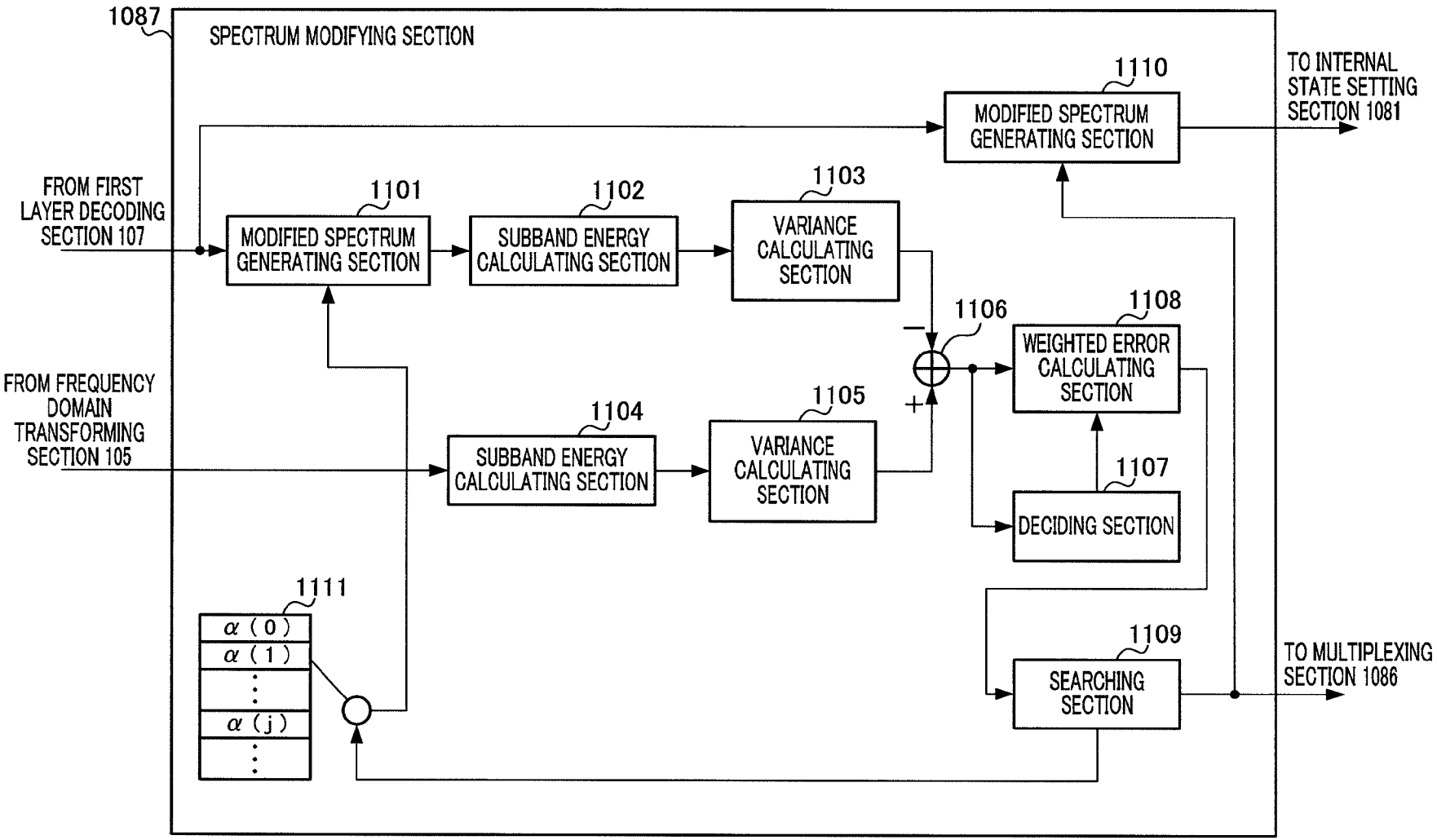
FIG. 23 is a block configuration diagram showing a spectrum modifying section according to Embodiment 6 of the present invention.

FIG. 23 shows the configuration of spectrum modifying section 1087. Spectrum modifying section 1087 modifies decoded spectrum S1(*k*) and adjusts the dynamic range of decoded spectrum S1(*k*) closer to the dynamic range of the high band ($FL \leqq k < FH$) of residual spectrum S2(*k*). Further, spectrum modifying section 1087 encodes modification information and outputs encoded modification information.

In spectrum modifying section 1087 shown in FIG. 23, modified spectrum generating section 1101 generates modified decoded spectrum S1'(*j, k*) by modifying decoded spectrum S1(*k*) and outputs modified decoded spectrum S1'(*j, k*) to subband energy calculating section 1102. Here, j is an index for identifying each encoding candidate (each modification information) of codebook 1111, and modified spectrum generating section 1101 modifies decoded spectrum S1(*k*) using each encoding candidate (each modification information) included in codebook 1111. Here, a case will be described as an example where a spectrum is modified using an exponential function. For example, when the encoding candidates included in codebook 1111 are represented as α(j), each encoding candidate α(j) is within the range of $0 \leqq \alpha(j) \leqq 1$. In this way, modified decoded spectrum S1'($j$, $k$) is represented by equation 15.

(Equation 15)

$$S1'(j,k)=\text{sign}(S1(k))\cdot|S1(k)|^{\alpha(j)} \quad [15]$$

Here, sign( ) is the function for returning a positive or negative sign. Consequently, when encoding candidate $\alpha(j)$ takes a value closer to "zero," the dynamic range of the modified decoded spectrum S1'($j$, $k$) becomes smaller.

Subband energy calculating section 1102 divides the frequency band of modified decoded spectrum S1'($j$, $k$) into a plurality of subbands, calculates average energy (subband energy) P1($j$, $n$) of each subband, and outputs average energy P1($j$, $n$) to variance calculating section 1103. Here, n is a subband number.

Variance calculating section 1103 calculates variance $\sigma 1(j)^2$ of subband energy P1($j$, $n$) to show the degree of dispersion of subband energy P1($j$, $n$). Then, variance calculating section 1103 outputs variance $\sigma 1(j)^2$ of encoding candidate (modification information) j to subtracting section 1106.

On the other hand, subband energy calculating section 1104 divides the high band of residual spectrum S2($k$) into a plurality of subbands, calculates average energy (subband energy) P2($n$) of each subband and outputs average energy P2 to variance calculating section 1105.

To show the degree of dispersion of subband energy P2($n$), variance calculating section 1105 calculates variance $\sigma 2^2$ of subband energy P2($n$), and outputs variance $\sigma 2^2$ of subband energy P2($n$) to subtracting section 1106.

Subtracting section 1106 subtracts variance $\sigma 1(j)^2$ from variance $\sigma 2^2$ and outputs an error signal obtained by this subtraction to deciding section 1107 and weighted error calculating section 1108.

Deciding section 1107 decides a sign (positive or negative) of the error signal and determines the weight given to weighted error calculating section 1108 based on the decision result. If the sign of the error signal is positive, deciding section 1107 selects $w_{pos}$, and if the sign of the error signal is negative, selects $w_{neg}$ as the weight, and outputs the weight to weighted error calculating section 1108. The relationship shown in equation 16 holds between $w_{pos}$ and $w_{neg}$.

(Equation 16)

$$0<w_{pos}<w_{neg} \quad [16]$$

First, weighted error calculating section 1108 calculates the square value of the error signal inputted from subtracting section 1106, then calculates weighted square error E by multiplying the square value of the error signal by weight W ($w_{pos}$ or $w_{neg}$) inputted from deciding section 1107 and outputs weighted square error E to searching section 1109. Weighted square error E is represented by equation 17.

(Equation 17)

$$E=w\cdot(\sigma 2^2-\sigma 1(j)^2)^2$$

$$(w=w_{neg} \text{ or } w_{pos}) \quad [17]$$

Searching section 1109 controls codebook 1111 to output encoding candidates (modification information) stored in codebook 1111 sequentially to modified spectrum generating section 1101 and search for the encoding candidate (modification information) that minimizes weighted square error E. Then, searching section 1109 outputs index $j_{opt}$ of the encoding candidate that minimizes weighted square error E as optimum modification information to modified spectrum generating section 1110 and multiplexing section 1086.

Modified spectrum generating section 1110 generates modified decoded spectrum S1'($j_{opt}$, $k$) corresponding to optimum modification information $j_{opt}$ by modifying decoded spectrum S1($k$) and outputs modified decoded spectrum S1' ($j_{opt}$, $k$) to internal state setting section 1081.

Figure 24:
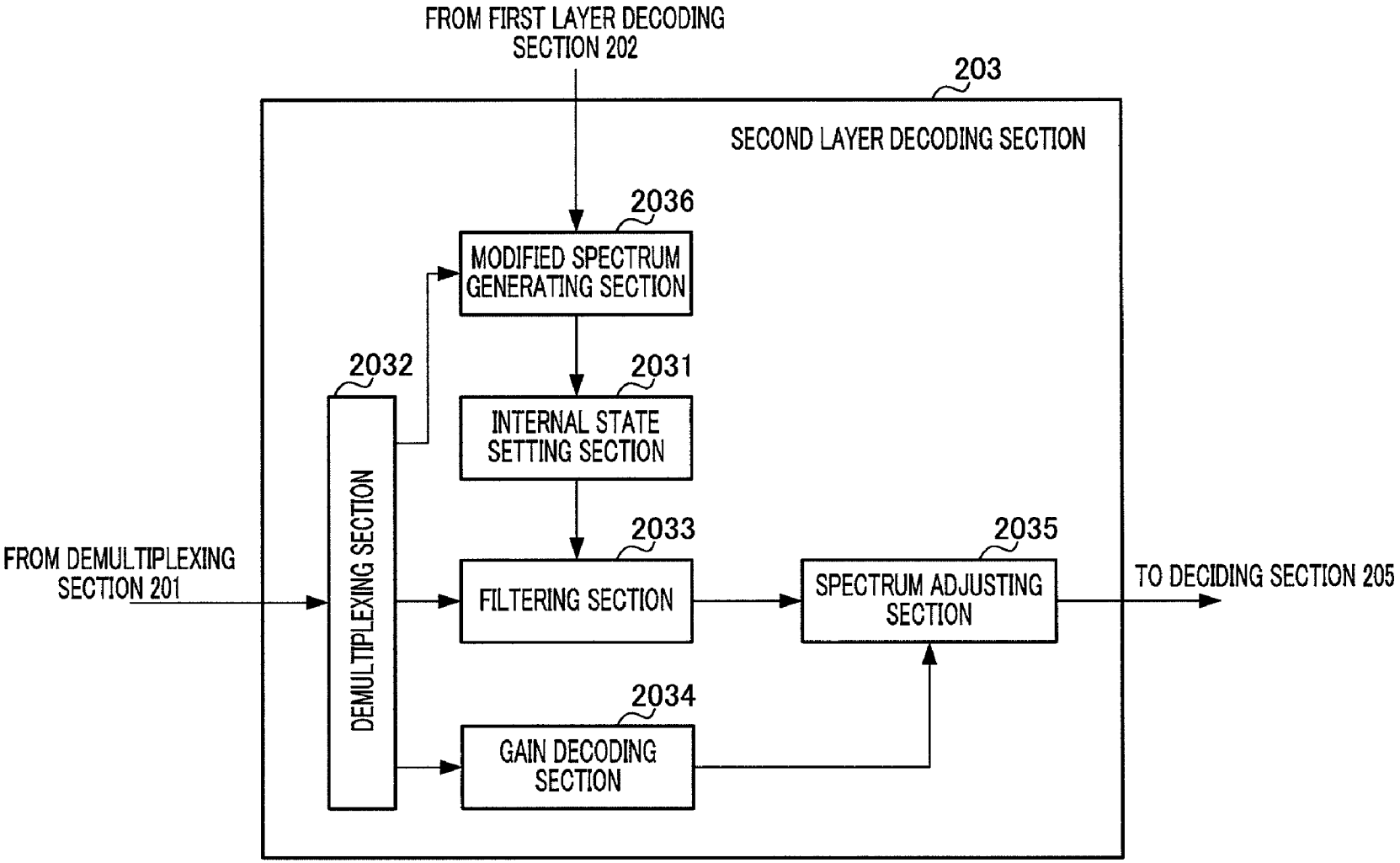
FIG. 24 is a block configuration diagram showing the second layer decoding section according to Embodiment 6 of the present invention.

Next, second layer decoding section 203 of the speech decoding apparatus according to this embodiment will be described. FIG. 24 shows the configuration of second layer decoding section 203 according to Embodiment 6 of the present invention. In FIG. 24, the same components as in Embodiment 1 (FIG. 10) will be assigned the same reference numerals and repetition of description will be omitted.

In second layer decoding section 203, modified spectrum generating section 2036 generates modified decoded spectrum S1'($j_{opt}$, $k$) by modifying first layer decoded spectrum S1($k$) inputted from first layer decoding section 202 based on optimum modification information $j_{opt}$ inputted from demultiplexing section 2032, and outputs modified decoded spectrum S1'($j_{opt}$, $k$) to internal state setting section 2031. That is, modified spectrum generating section 2036 is provided in relationship to modified spectrum generating section 1110 on the speech encoding apparatus side and carries out the same processing as in modified spectrum generating section 1110.

As described above, a case where the weight for calculating the weighted square error is determined according to the sign of the error signal and the weight includes a relationship shown in equation 16, can be described as follows.

That is, a case where the error signal is positive refers to a case where the degree of dispersion of modified decoded spectrum S1' becomes less than the degree of dispersion of residual spectrum S2 as the target value. That is, this corresponds to a case where the dynamic range of modified decoded spectrum S1' generated on the speech decoding apparatus side becomes smaller than the dynamic range of residual spectrum S2.

On the other hand, a case where the error signal is negative refers to a case where the degree of dispersion of modified decoded spectrum S1' is greater than the degree of dispersion of residual spectrum S2 which is the target value. That is, this corresponds to a case where the dynamic range of modified decoded spectrum S1' generated on the speech decoding apparatus side becomes larger than the dynamic range of residual spectrum S2.

Consequently, as shown in equation 16, by setting weight $w_{pos}$ in a case where the error signal is positive, smaller than weight $w_{neg}$ in a case where the error signal is negative, when the square error is almost the same value, encoding candidates that generate modified decoded spectrum S1' with a smaller dynamic range than the dynamic range of residual spectrum S2 are more likely to be selected. That is, encoding candidates that suppress the dynamic range are preferentially selected. Consequently, the dynamic range of an estimated spectrum generated in the speech decoding apparatus less frequently becomes larger than the dynamic range of the high band of the residual spectrum.

Here, when the dynamic range of modified decoded spectrum S1' becomes larger than the target dynamic range of the spectrum, an undesirable peak occurs in the estimated spectrum in the speech decoding apparatus and becomes more perceptible to human ears as quality deterioration. On the other hand, when the dynamic range of modified decoded spectrum S1', becomes smaller than the target dynamic range of the spectrum, an undesirable peak as described above is less likely to occur in the estimated spectrum in the speech decoding apparatus. That is, according to this embodiment, in a case where a technique for adjusting the dynamic range of the low band spectrum to the dynamic range of the high band spectrum, is applied to Embodiment 1, it is possible to prevent perceptual quality deterioration.

Further, although an example has been described with the above description where the exponential function is used as a spectrum modifying method, this embodiment is not limited to this, and other spectrum modifying methods, for example, a spectrum modifying method using the logarithmic function, may be used.

Further, although a case has been described with the above description where the variance of average subband energy is used, the present invention is not limited to the variance of average subband energy as long as indices showing the amount of the dynamic range of a spectrum are used.

Embodiment 7

Figure 25:
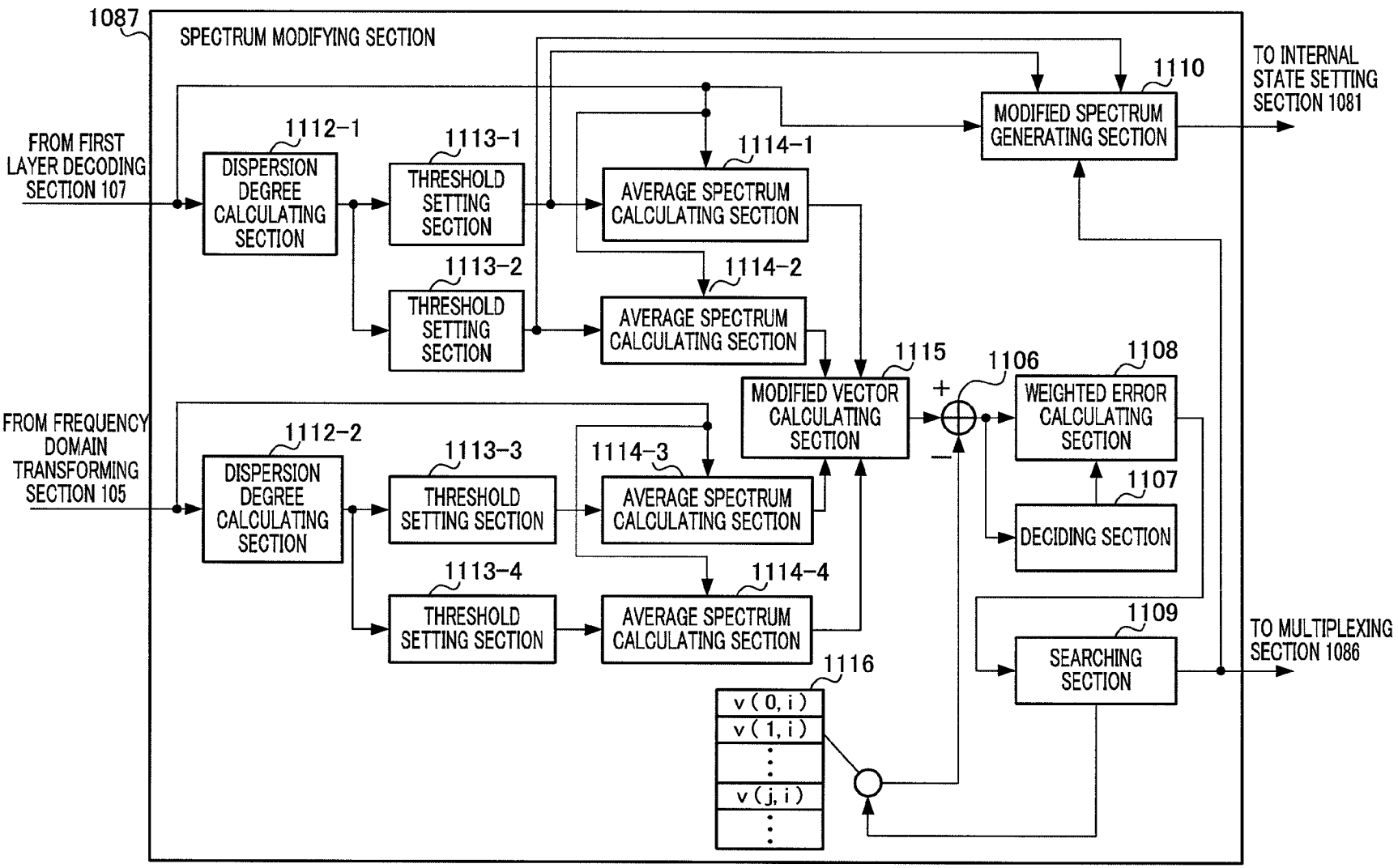
FIG. 25 is a block configuration diagram showing a spectrum modifying section according to Embodiment 7 of the present invention.

FIG. 25 shows the configuration of spectrum modifying section 1087 according to Embodiment 7 of the present invention. In FIG. 25, the same components as in Embodiment 6 (FIG. 23) will be assigned the same reference numerals and repetition of description will be omitted.

In spectrum modifying section 1087 shown in FIG. 25, dispersion degree calculating section 1112-1 calculates the degree of dispersion of decoded spectrum S1(*k*) from the distribution of values in the low band of decoded spectrum S1(*k*), and outputs the degree of dispersion to threshold setting sections 1113-1 and 1113-2. To be more specific, the degree of dispersion is standard deviation σ1 of decoded spectrum S1(*k*).

Threshold setting section 1113-1 finds first threshold TH1 using standard deviation σ1 and outputs threshold TH1 to average spectrum calculating section 1114-1 and modified spectrum generating section 1110. Here, first threshold TH1 refers to a threshold for specifying the spectral values with comparatively high amplitude among decoded spectrum S1(*k*), and uses the value obtained by multiplying standard deviation σ1 by predetermined constant a.

Threshold setting section 1113-2 finds second threshold TH2 using standard deviation σ1 and outputs second threshold TH2 to average spectrum calculating section 1114-2 and modified spectrum generating section 1110. Here, second threshold TH2 is a threshold for specifying the spectral values with comparatively low amplitude among the low band of decoded spectrum S1(*k*), and uses the value obtained by multiplying standard deviation σ1 by predetermined constant b(<a).

Average spectrum calculating section 1114-1 calculates an average amplitude value of a spectrum with higher amplitude than first threshold TH1 (hereinafter "first average value") and outputs the average amplitude value to modified vector calculating section 1115. To be more specific, average spectrum calculating section 1114-1 compares the spectral value of the low band of decoded spectrum S1(*k*) with the value (m1+TH1) obtained by adding first threshold TH1 to average value m1 of decoded spectrum S1(*k*), and specifies the spectral values with higher values than this value (step 1). Next, average spectrum calculating section 1114-1 compares the spectral value of the low band of decoded spectrum S1(*k*) with the value (m1−TH1) obtained by subtracting first threshold TH1 from average value m1 of decoded spectrum S1(*k*), and specifies the spectral values with lower values than this value (step 2). Then, average spectrum calculating section 1114-1 calculates an average amplitude value of the spectral values determined in step 1 and step 2 and outputs the average amplitude value of the spectral values to modified vector calculating section 1115.

Average spectrum calculating section 1114-2 calculates an average amplitude value (hereinafter "second average value") of the spectral values with lower amplitude than second threshold TH2, and outputs the average amplitude value to modified vector calculating section 1115. To be more specific, average spectrum calculating section 1114-2 compares the spectral value of the low band of decoded spectrum S1(*k*) with the value (m1+TH2) obtained by adding second threshold TH2 to average value m1 of decoded spectrum S1(*k*), and specifies the spectral values with lower values than this value (step 1). Next, average spectrum calculating section 1114-2 compares the spectral value of the low band of decoded spectrum S1(*k*) with the value (m1−TH2) obtained by subtracting second threshold TH2 from average value m1 of decoded spectrum S1(*k*), and specifies the spectral values with higher values than this value (step 2). Then, average spectrum calculating section 1114-2 calculates an average amplitude value of the spectral values determined in step 1 and step 2 and outputs the average amplitude value of the spectrum to modified vector calculating section 1115.

On the other hand, dispersion degree calculating section 1112-2 calculates the degree of dispersion of residual spectrum S2(*k*) from the distribution of values in the high band of residual spectrum S2(*k*) and outputs the degree of dispersion to threshold setting sections 1113-3 and 1113-4. To be more specific, the degree of dispersion is standard deviation σ2 of residual spectrum S2(*k*).

Threshold setting section 1113-3 finds third threshold TH3 using standard deviation σ2 and outputs third threshold TH3 to average spectrum calculating section 1114-3. Here, third threshold TH3 is a threshold for specifying the spectral values with comparatively high amplitude among the high band of residual spectrum S2(*k*), and uses the value obtained by multiplying standard deviation σ2 by predetermined constant c.

Threshold setting section 1113-4 finds fourth threshold TH4 using standard deviation σ2 and outputs fourth threshold TH4 to average spectrum calculating section 1114-4. Here, fourth threshold TH4 is a threshold for specifying the spectral values with comparatively low amplitude among the high band of residual spectrum S2(*k*), and the value obtained by multiplying standard deviation σ2 by predetermined constant d(<c) is used.

Average spectrum calculating section 1114-3 calculates an average amplitude value (hereinafter "third average value") of the spectral values with higher amplitude than third threshold TH3 and outputs the average amplitude value to modified vector calculating section 1115. To be more specific, average spectrum calculating section 1114-3 compares the spectral value of the high band of residual spectrum S2(*k*) with the value (m3+TH3) obtained by adding third threshold TH3 to average value m3 of residual spectrum S2(*k*), and specifies the spectral values with higher values than this value (step 1). Next, average spectrum calculating section 1114-3 compares the spectral value of the high band of residual spectrum S2(*k*) with the value (m3−TH3) obtained by subtracting third threshold TH3 from average value m3 of residual spectrum S2(*k*), and specifies the spectral values with lower values than this value (step 2). Then, average spectrum calculating section 1114-3 calculates an average amplitude value of the spectral values determined in step 1 and step 2, and outputs the average amplitude value of the spectrum to modified vector calculating section 1115.

Average spectrum calculating section 1114-4 calculates an average amplitude value (hereinafter "fourth average value") of the spectral values with lower amplitude than fourth threshold TH4, and outputs the average amplitude value to modified vector calculating section 1115. To be more specific, average spectrum calculating section 1114-4 compares the spectral value of the high band of residual spectrum S2(*k*) with the value (m3+TH4) obtained by adding fourth threshold TH4 to average value m3 of residual spectrum S2(*k*), and specifies the spectral values with lower values than this value (step 1). Next, average spectrum calculating section 1114-4 compares the spectral value of the high band of residual spectrum S2(*k*) with the value (m3−TH4) obtained by subtracting fourth threshold TH4 from average value m3 of residual spectrum S2(*k*), and specifies the spectral values with higher values than this value (step 2). Then, average spectrum calculating section 1114-4 calculates an average amplitude value of the spectrum determined in step 1 and step 2, and outputs the average amplitude value of the spectrum to modified vector calculating section 1115.

Modified vector calculating section 1115 calculates a modified vector as described below using the first average value, the second average value, the third average value and the fourth average value.

That is, modified vector calculating section 1115 calculates the ratio of the third average value to the first average value (hereinafter the "first gain") and the ratio of the fourth average value to the second average value (hereinafter the "second gain"), and outputs the first gain and the second gain to subtracting section 1106 as modified vectors. Hereinafter, a modified vector is represented as g(i) (i=1, 2). That is, g(1) is the first gain and g(2) is the second gain.

Subtracting section 1106 subtracts encoding candidates that belong to modified vector codebook 1116, from modified vector g(i), and outputs the error signal obtained from this subtraction to deciding section 1107 and weighted error calculating section 1108. Hereinafter, encoding candidates are represented as v(j, i). Here, j is an index for identifying each encoding candidate (each modification information) of modified vector codebook 1116.

Deciding section 1107 decides the sign of an error signal (positive or negative), and determines a weight given to weighted error calculating section 1108 for first gain g(1) and second gain g(2), respectively based on the decision result. With respect to first gain g(1), if the sign of the error signal is positive, deciding section 1107 selects $w_{light}$ as the weight, and, if the sign of the error signal is negative, selects $w_{heavy}$ as the weight, and outputs the result to weighted error calculating section 1108. On the other hand, with respect to second gain g(2), if the sign of the error signal is positive, deciding section 1107 selects $w_{heavy}$ as the weight, and, if the sign of the error signal is negative, selects $w_{light}$ as the weight, and outputs the result to weighted error calculating section 1108. The relationship shown in equation 18 holds between $w_{light}$ and $w_{heavy}$.

(Equation 18)

$$0 < w_{light} < w_{heavy} \quad [18]$$

First, weighted error calculating section 1108 calculates the square value of the error signal inputted from subtracting section 1106, then calculates weighted square error E by calculating the sum of product of the square value of the error signal and each weight w($w_{light}$ or $w_{heavy}$) inputted from deciding section 1107 for first gain g(1) and second gain g(2) and outputs weighted square error E to searching section 1109. Weighted square error E is represented by equation 19.

(Equation 19)

$$E = \sum_{i=1}^{2} w(i) \cdot (g(i) - v(j, i))^2 \quad [19]$$

$$(w(i) = w_{light} \text{ or } w_{heavy})$$

Searching section 1109 controls modified vector codebook 1116 to output encoding candidates (modification information) stored in modified vector codebook 1116 sequentially to subtracting section 1106, and searches for the encoding candidate (modification information) that minimizes weighted square error E. Then, searching section 1109 outputs index $j_{opt}$ of the encoding candidate that minimizes weighted square error E to modified spectrum generating section 1110 and multiplexing section 1086 as optimum modification information.

Modified spectrum generating section 1110 generates modified decoded spectrum S1'($j_{opt}$, *k*) corresponding to optimum modification information $j_{opt}$ by modifying decoded spectrum S1(*k*) using first threshold TH1, second threshold TH2 and optimum modification information $j_{opt}$ and outputs modified decoded spectrum S1'($j_{opt}$, *k*) to internal state setting section 1081.

Modified spectrum generating section 1110, first, generates a decoded value (hereinafter the "decoded first gain") of the ratio of the third average value to the first average value and a decoded value (hereinafter the "decoded second gain") of the ratio of the fourth average value to the second average value using optimum modification information $j_{opt}$.

Next, modified spectrum generating section 1110 compares the amplitude value of decoded spectrum S1(*k*) with first threshold TH1, specifies the spectral values with higher amplitude than first threshold TH1 and generates modified decoded spectrum S1'($j_{opt}$, *k*) by multiplying these spectral values by the decoded first gain. Similarly, modified spectrum generating section 1110 compares the amplitude value of decoded spectrum S1(*k*) with second threshold TH2, specifies spectral values with lower amplitude than second threshold TH2 and generates modified decoded spectrum S1'($j_{opt}$, *k*) by multiplying these spectral values by the decoded second gain.

Further, among decoded spectrum S1(*k*), there is no encoding information of the spectrum having spectrum values between first threshold TH1 and second threshold TH2. Then, modified spectrum generating section 1110 uses a gain of an intermediate value between the decoded first gain and the decoded second gain. For example, modified spectrum generating section 1110 finds decoded gain y corresponding to given amplitude x from a characteristic curve based on the decoded first gain, the decoded second gain, first threshold TH1 and second threshold TH2, and multiplies amplitude of decoded spectrum S1(*k*) by this decoded gain y. That is, decoded gain y is a linear interpolation value of the decoded first gain and the decoded second gain.

In this way, according to this embodiment, it is possible to acquire the same effect and advantage as in Embodiment 6.

Embodiment 8

Figure 26:
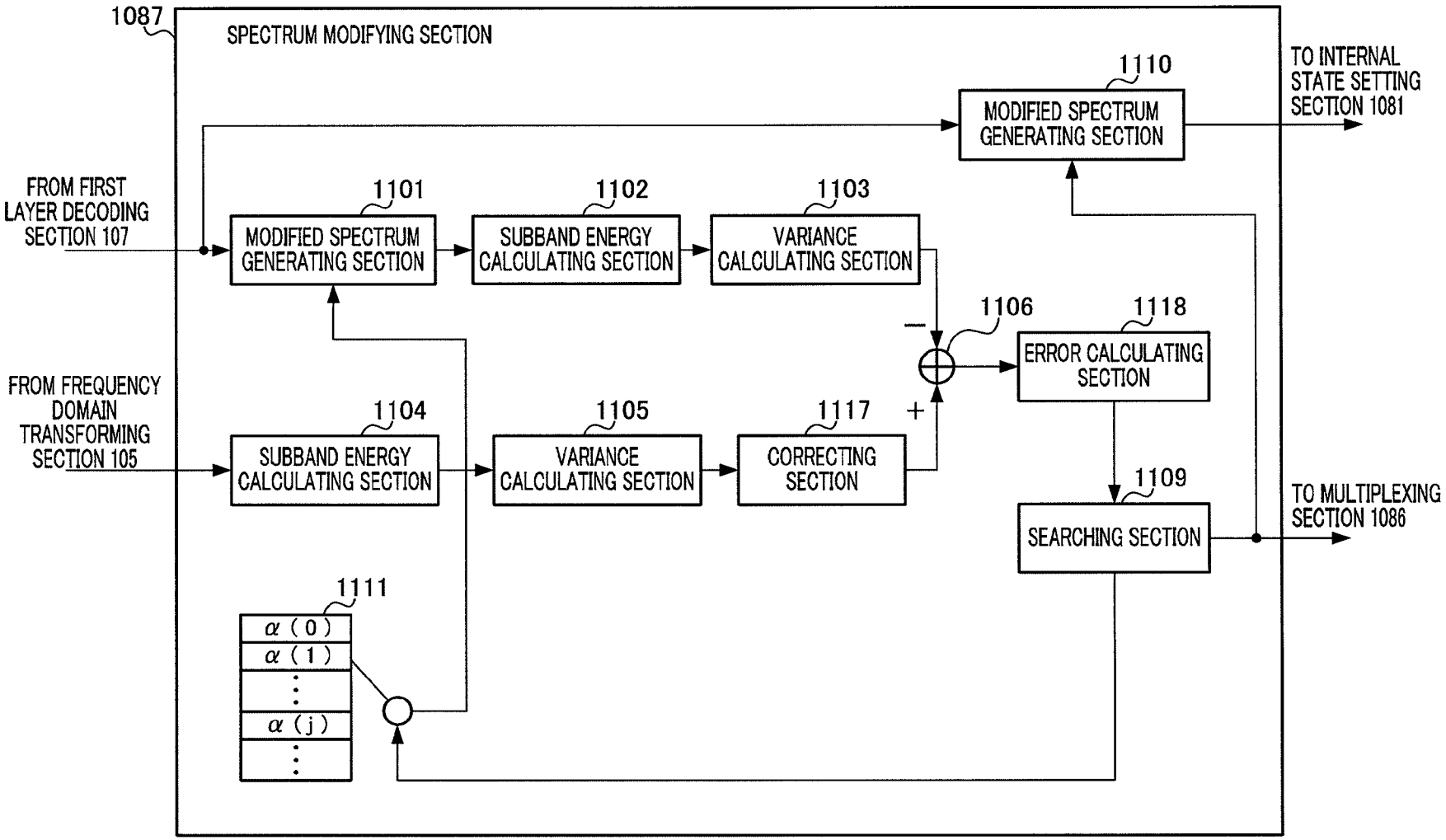
FIG. 26 is a block configuration diagram showing a spectrum modifying section according to Embodiment 8 of the present invention.

FIG. 26 shows the configuration of spectrum modifying section 1087 according to Embodiment 8 of the present invention. In FIG. 26, the same components as in Embodiment 6 (FIG. 23) will be assigned the same reference numerals and repetition of description will be omitted.

In spectrum modifying section 1087 shown in FIG. 26, correcting section 1117 receives an input of variance σ22 from variance calculating section 1105.

Correcting section 1117 carries out correction processing such that the value of variance o22 becomes smaller and outputs the result to subtracting section 1106. To be more specific, correcting section 1117 multiplies variance $\sigma 2^2$ by a value equal to or more than 0 and less than 1.

Subtracting section 1106 subtracts variance $\sigma 1(j)^2$ from the variance after the correction processing, and outputs the error signal obtained by this subtraction to error calculating section 1118.

Error calculating section 1118 calculates the square value (square error) of the error signal inputted from subtracting section 1106 and outputs the square value to searching section 1109.

Searching section 1109 controls codebook 1111 to output encoding candidates (modification information) stored in codebook 1111 sequentially to modified spectrum generating section 1101, and searches for the encoding candidate (modification information) that minimizes the square error. Then, searching section 1109 outputs index $j_{opt}$ of the encoding candidate that minimizes the square error to modified spectrum generating section 1110 and multiplexing section 1086 as optimum modification information.

In this way, according to this embodiment, after the correction processing in correcting section 1117, in searching section 1109, encoding candidate search is carried out such that the variance after the correction processing, that is, the variance with a value set smaller, is a target value. Consequently, the speech decoding apparatus is able to suppress the dynamic range of an estimated spectrum, so that it is possible to further reduce the frequency of occurrences of an undesirable peak as described above.

Further, according to characteristics of an input speech signal, correcting section 1117 may change the value to be multiplied by variance $\sigma 2^2$. The degree of pitch periodicity of an input speech signal is used as a characteristic. That is, if the pitch periodicity of the input speech signal is low (for example, pitch gain is low), correcting section 1117 may set a value to be multiplied by variance $\sigma 2^2$ greater, and, if the pitch periodicity of the input speech signal is high (for example, pitch gain is high), may set a value to be multiplied by variance $\sigma 2^2$ smaller. According to such adaptation, an undesirable spectral peak is less likely to occur only with respect to signals where the pitch periodicity is high (for example, the vowel part), and, as a result, it is possible to improve perceptual speech quality.

Embodiment 9

Figure 27:
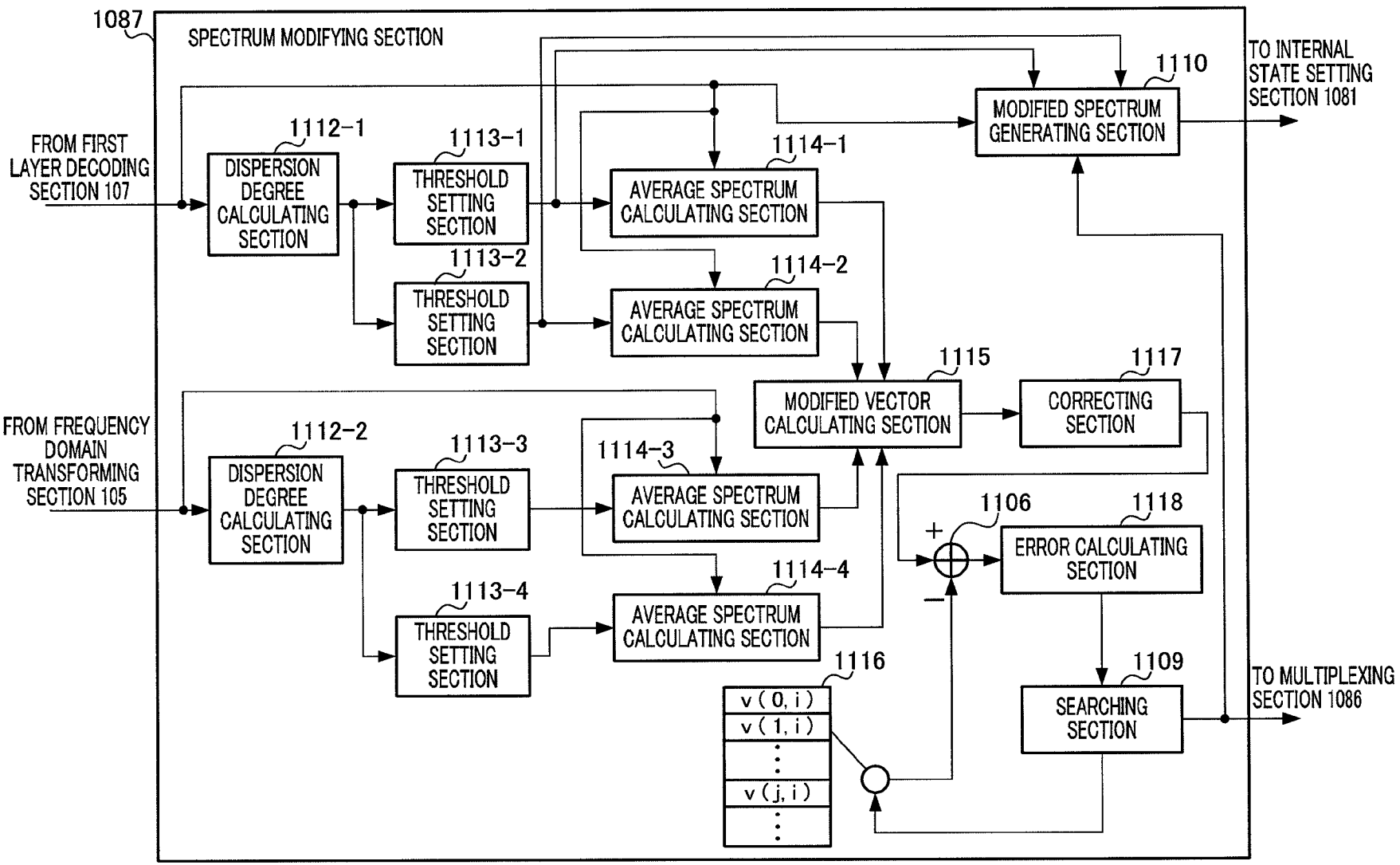
FIG. 27 is a block configuration diagram showing a spectrum modifying section according to Embodiment 9 of the present invention.

FIG. 27 shows the configuration of spectrum modifying section 1087 according to Embodiment 9 of the present invention. In FIG. 27, the same components as in Embodiment 7 (FIG. 25) will be assigned the same reference numerals and repetition of description will be omitted.

In spectral modifying section 1087 shown in FIG. 27, correcting section 1117 receives an input of modified vector g(i) from modified vector calculating section 1115.

Correcting section 1117 carries out at least one of correction processing such that the value of first gain g(1) becomes smaller and correction processing such that the value of second gain g(2) becomes larger and outputs the result to subtracting section 1106. To be more specific, correcting section 1117 multiplies first gain g(1) by a value equal to or more than 0 and less than 1, and multiplies second gain g(2) by a value higher than 1.

Subtracting section 1106 subtracts encoding candidates that belong to modified vector codebook 1116 from modified vector after the correction processing, and outputs an error signal obtained by this subtraction to error calculating section 1118.

Error calculating section 1118 calculates the square value (square error) of the error signal inputted from subtracting section 1106 and outputs the square value to searching section 1109.

Searching section 1109 controls modified vector codebook 1116 to output encoding candidates (modification information) stored in modified vector codebook 1116 sequentially to subtracting section 1106, and searches for the encoding candidate (modification information) that minimizes the square error. Then, searching section 1109 outputs index $j_{opt}$ of the encoding candidate that minimizes the square error, to modified spectrum generating section 1110 and multiplexing section 1086 as optimum modification information.

In this way, according to this embodiment, after the correction processing in correcting section 1117, in searching section 1109, encoding candidate search is carried out such that a modified vector after the correction processing, that is, a modified vector that decreases a dynamic range, is a target value. Consequently, the speech decoding apparatus is able to suppress the dynamic range of the estimated spectrum, so that it is possible to further reduce the frequency of occurrences of an undesirable peak as described above.

Further, similar to Embodiment 8, in this embodiment, the value to be multiplied by modified vector g(i) may be changed in correcting section 1117 according to characteristics of an input speech signal. According to such adaptation, similar to Embodiment 8, an undesirable spectral peak is less likely to occur only with respect to signals where the pitch periodicity is high (for example, the vowel part), and, as a result, it is possible to improve perceptual speech quality.

Embodiment 10

Figure 28:
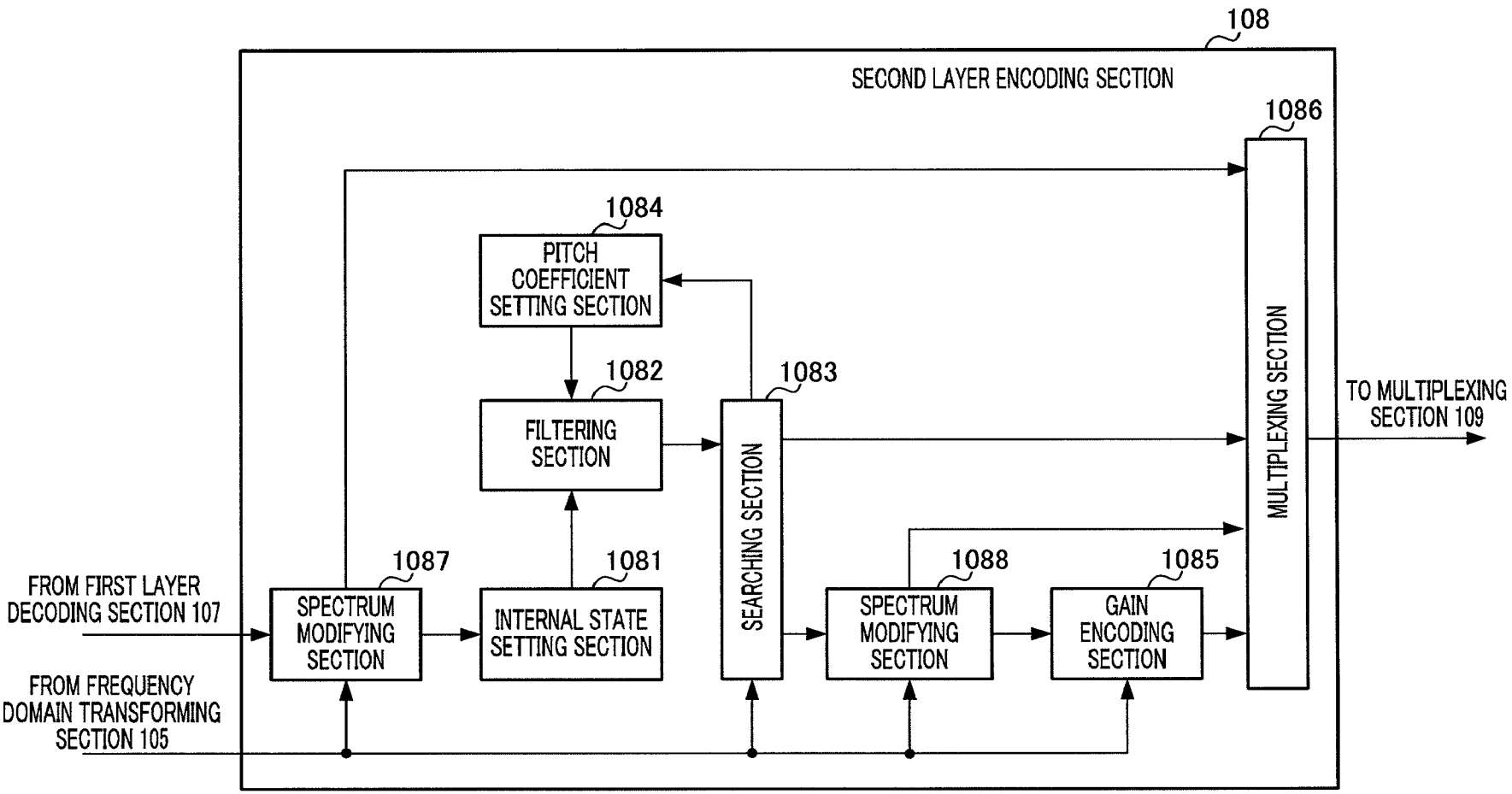
FIG. 28 is a block configuration diagram showing the second layer encoding section according to Embodiment 10 of the present invention.

FIG. 28 shows the configuration of second layer encoding section 108 according to Embodiment 10 of the present invention. In FIG. 28, the same components as in Embodiment 6 (FIG. 22) will be assigned the same reference numerals and repetition of description will be omitted.

In second layer encoding section 108 shown in FIG. 28, spectrum modifying section 1088 receives an input of residual spectrum S2(*k*) from frequency domain transforming section 105 and an input of an estimated value of the residual spectrum (estimated residual spectrum) S2'(*k*) from searching section 1083.

Referring to the dynamic range of the high band of residual spectrum S2(*k*), spectrum modifying section 1088 changes the dynamic range of estimated residual spectrum S2'(*k*) by modifying estimated spectrum S2'(*k*) Then, spectrum modifying section 1088 encodes modification information showing how estimated residual spectrum S2'(*k*) is modified, and outputs the modification information to multiplexing section 1086. Further, spectrum modifying section 1088 outputs modified estimated residual spectrum (modified residual spectrum) to gain encoding section 1085. Further, an internal configuration of spectrum modifying section 1088 is the same as spectrum modifying section 1087, and detailed description is omitted.

In processing in gain encoding section 1085, "estimated value S2'(*k*) of a residual spectrum" in Embodiment 1 is read as a "modified residual spectrum," and so detailed description is omitted.

Figure 29:
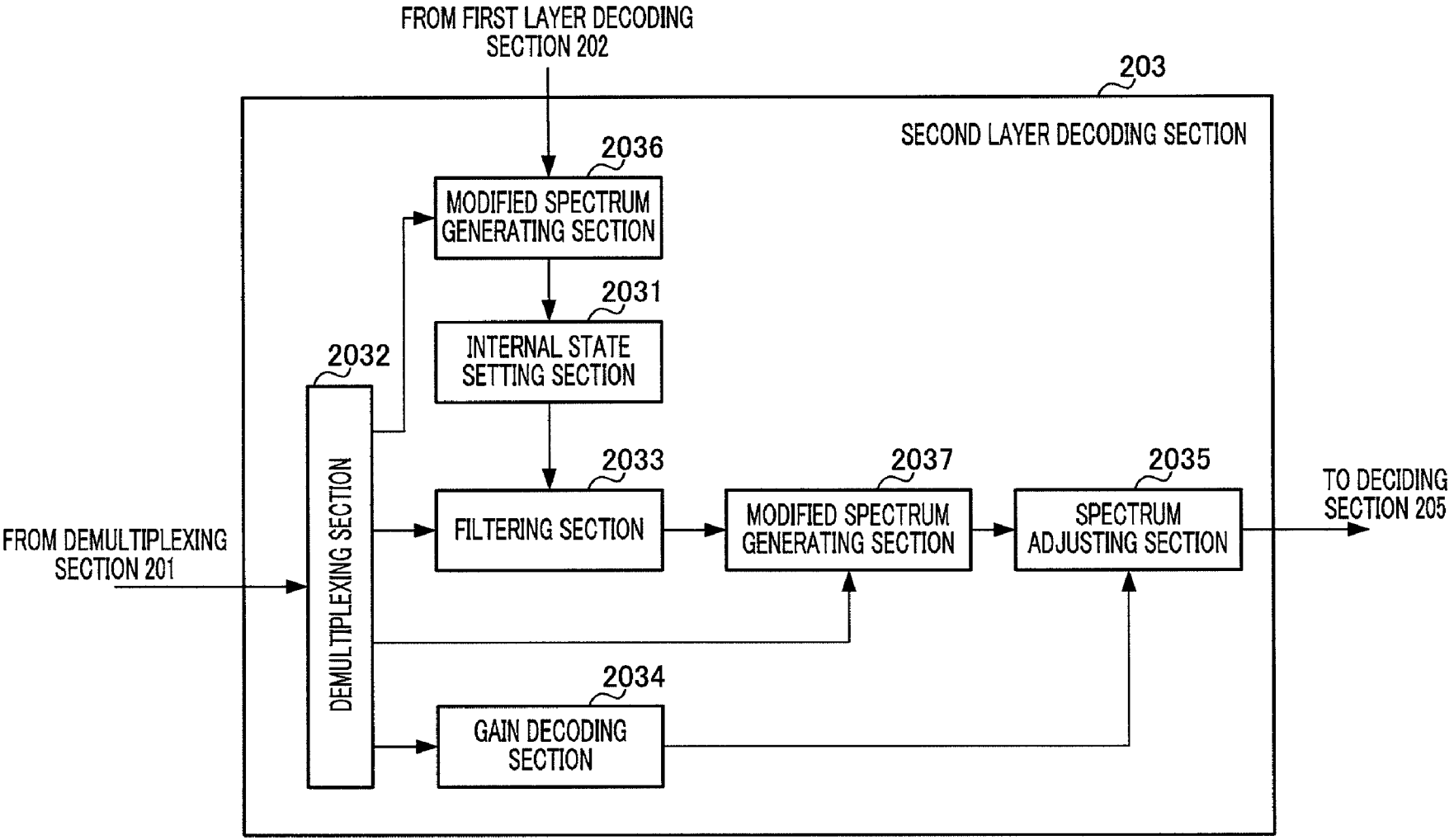
FIG. 29 is a block configuration diagram showing the second layer decoding section according to Embodiment 10 of the present invention.

Next, second layer decoding section 203 of the speech decoding apparatus according to this embodiment will be described. FIG. 29 shows the configuration of second layer decoding section 203 according to Embodiment 10 of the present invention. In FIG. 29, the same components as in Embodiment 6 (FIG. 24) will be assigned the same reference numerals and repetition of description will be omitted.

In second layer decoding section 203, modified spectrum generating section 2037 modifies decoded spectrum S'(k) inputted from filtering section 2033, based on optimum modification information $j_{opt}$ inputted from demultiplexing section 2032, that is, based on optimum modification information $j_{opt}$ related to the modified residual spectrum, and outputs decoded spectrum S'(k) to spectrum adjusting section 2035. That is, modified spectrum generating section 2037 is provided corresponding to spectrum modifying section 1088 on the speech encoding apparatus side and carries out the same processing of spectrum modifying section 1088.

In this way, according to this embodiment, estimated residual spectrum S2'(*k*) is modified in addition to decoded spectrum S1(*k*), so that it is possible to generate an estimated residual spectrum with an adequate dynamic range.

Embodiment 11

Figure 30:
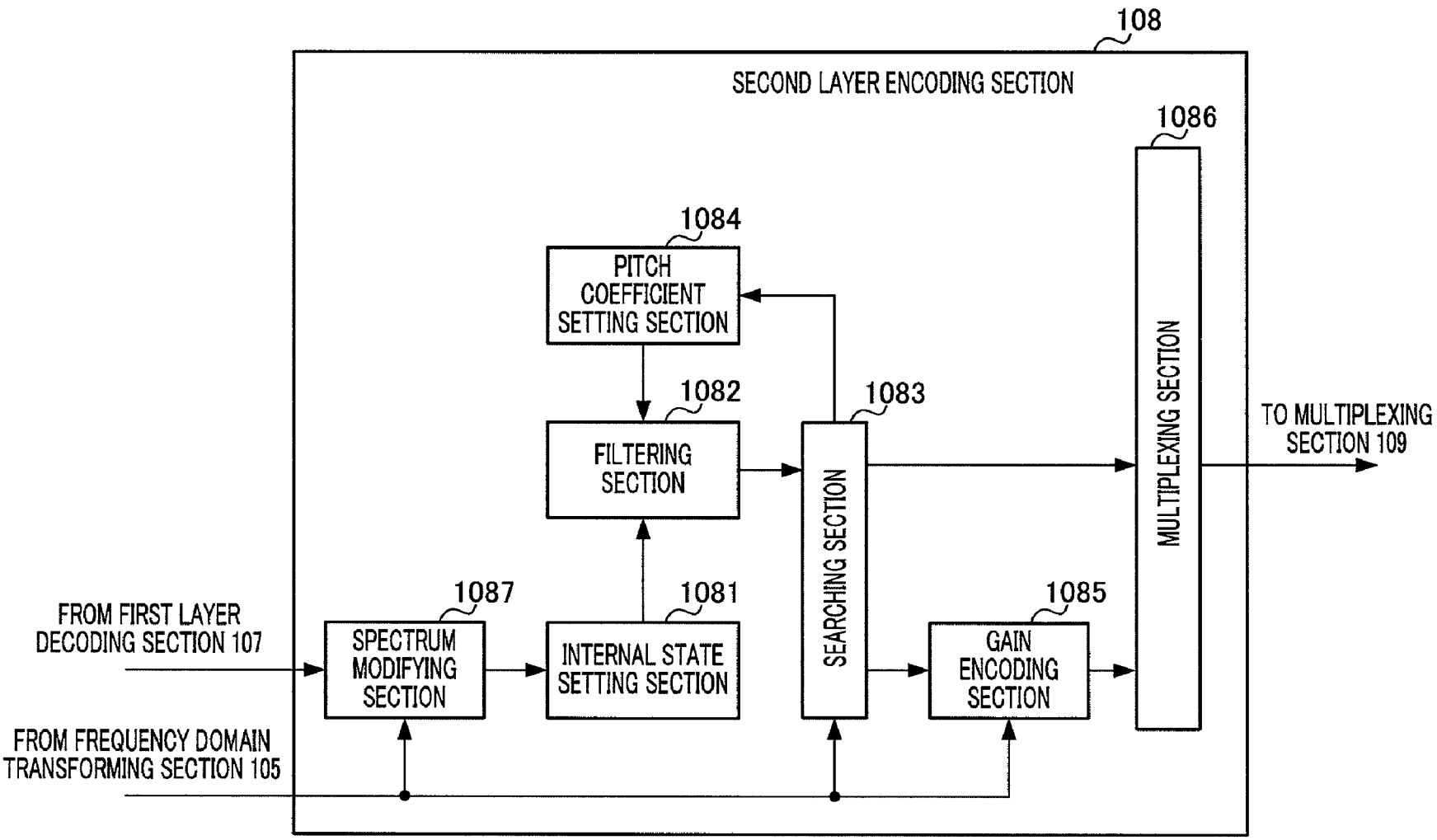
FIG. 30 is a block configuration diagram showing the second layer encoding section according to Embodiment 11 of the present invention.

FIG. 30 shows the configuration of second layer encoding section 108 according to Embodiment 11 of the present invention. In FIG. 30, the same components as in Embodiment 6 (FIG. 22) will be assigned the same reference numerals and repetition of description will be omitted.

In second layer encoding section 108 shown in FIG. 30, spectrum modifying section 1087 modifies decoded spectrum S1(*k*) according to predetermined modification information that is common between the speech encoding apparatus and the speech decoding apparatus and changes the dynamic range of decoded spectrum S1(*k*). Then, spectrum modifying section 1087 outputs modified decoded spectrum S1'(*j, k*) to internal state setting section 1081.

Figure 31:
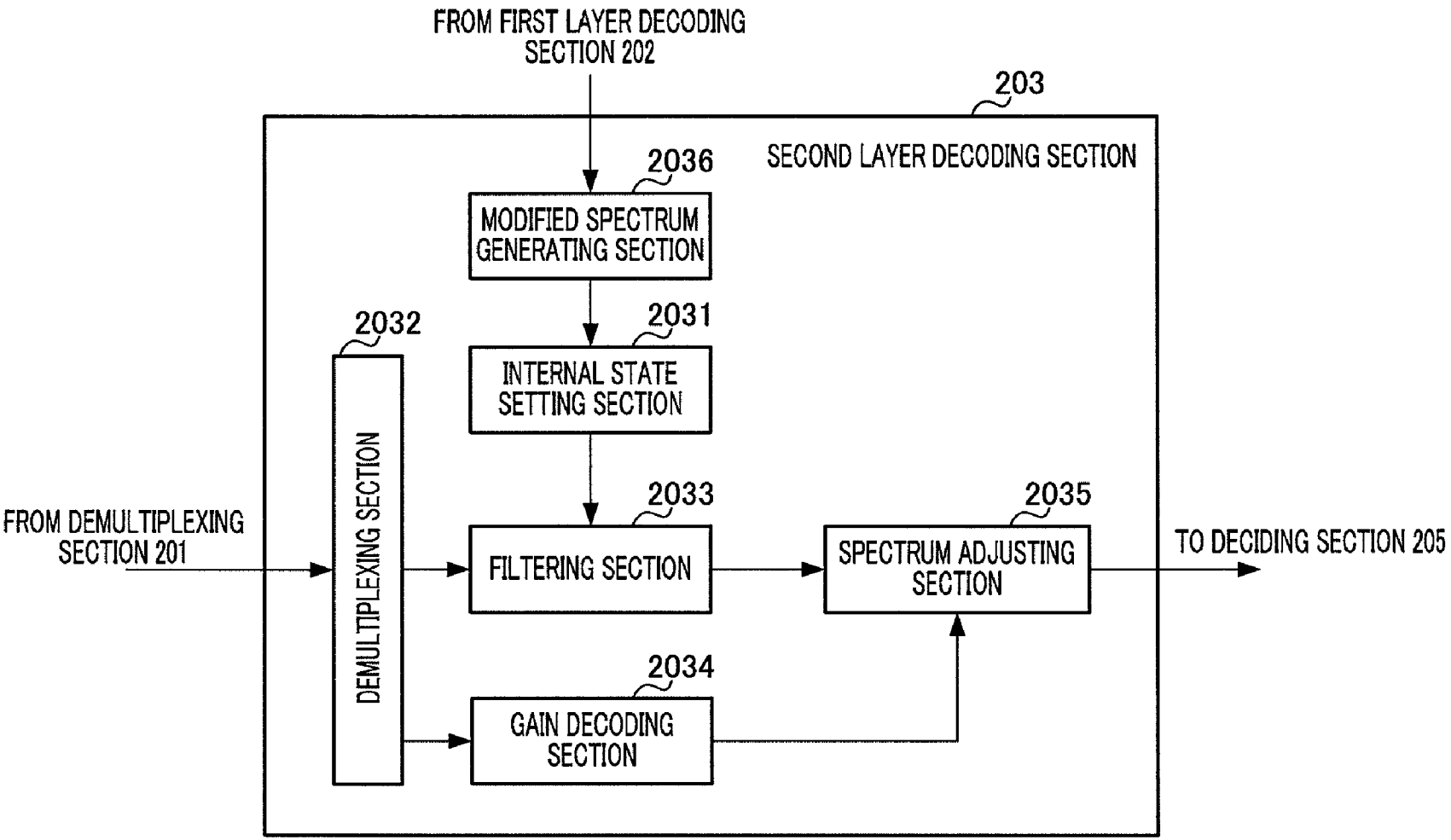
FIG. 31 is a block configuration diagram showing the second layer decoding section according to Embodiment 11 of the present invention.

Next, second layer decoding section 203 of the speech decoding apparatus according to the present invention will be described. FIG. 31 shows the configuration of second layer decoding section 203 according to Embodiment 11 of the present invention. In FIG. 31, the same components as in Embodiment 6 (FIG. 24) will be assigned the same reference numerals and repetition of description will be omitted.

In second layer decoding section 203, modified spectrum generating section 2036 modifies first layer decoded spectrum S1(*k*) inputted from first layer decoding section 202 according to predetermined modification information that is common between the speech decoding apparatus and the speech encoding apparatus, that is, according to the same modification information as the predetermined modification information used at spectrum modifying section 1087 of FIG. 30, and outputs first layer decoded spectrum S1(*k*) to internal state setting section 2031.

In this way, according to this embodiment, spectrum modifying section 1087 of the speech encoding apparatus and modified spectrum generating section 2036 of the speech decoding apparatus carries out modification processing according to the same predetermined modification information, so that it is not necessary to transmit modification information from the speech encoding apparatus to the speech decoding apparatus. Consequently, according to this embodiment, it is possible to reduce the bit rate compared to Embodiment 6.

Further, spectrum modifying section 1088 shown in FIG. 28 and modified spectrum generating section 2037 shown in FIG. 29 may carry out modification processing according to the same predetermined modification information. By this means, it is possible to further reduce the bit rate.

Embodiment 12

Figure 32:
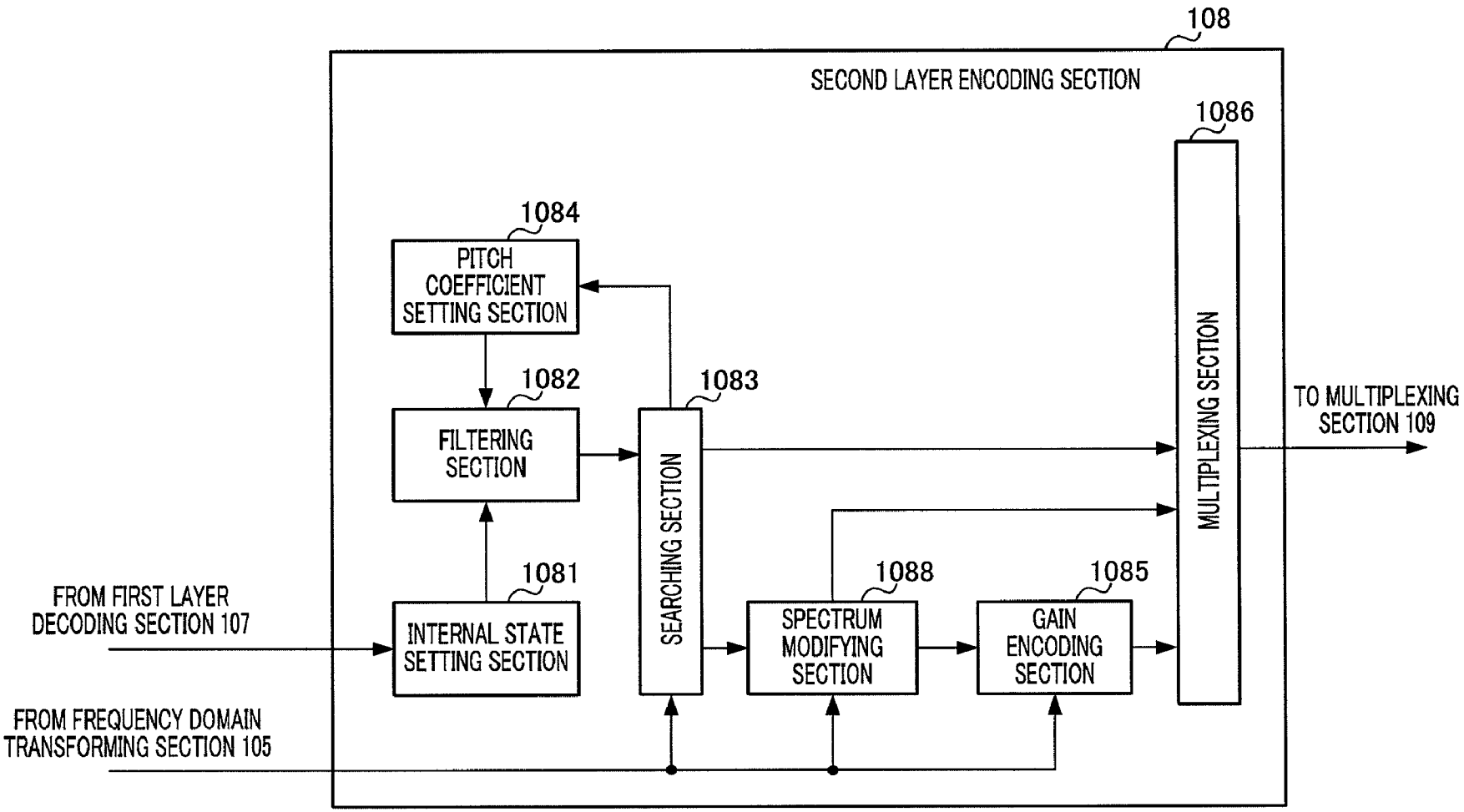
FIG. 32 is a block configuration diagram showing the second layer encoding section according to Embodiment 12 of the present invention.

Second layer encoding section 108 of Embodiment 10 may employ a configuration without spectrum modifying section 1087. Then, FIG. 32 shows the configuration of second layer encoding section 108 according to Embodiment 12.

Figure 33:
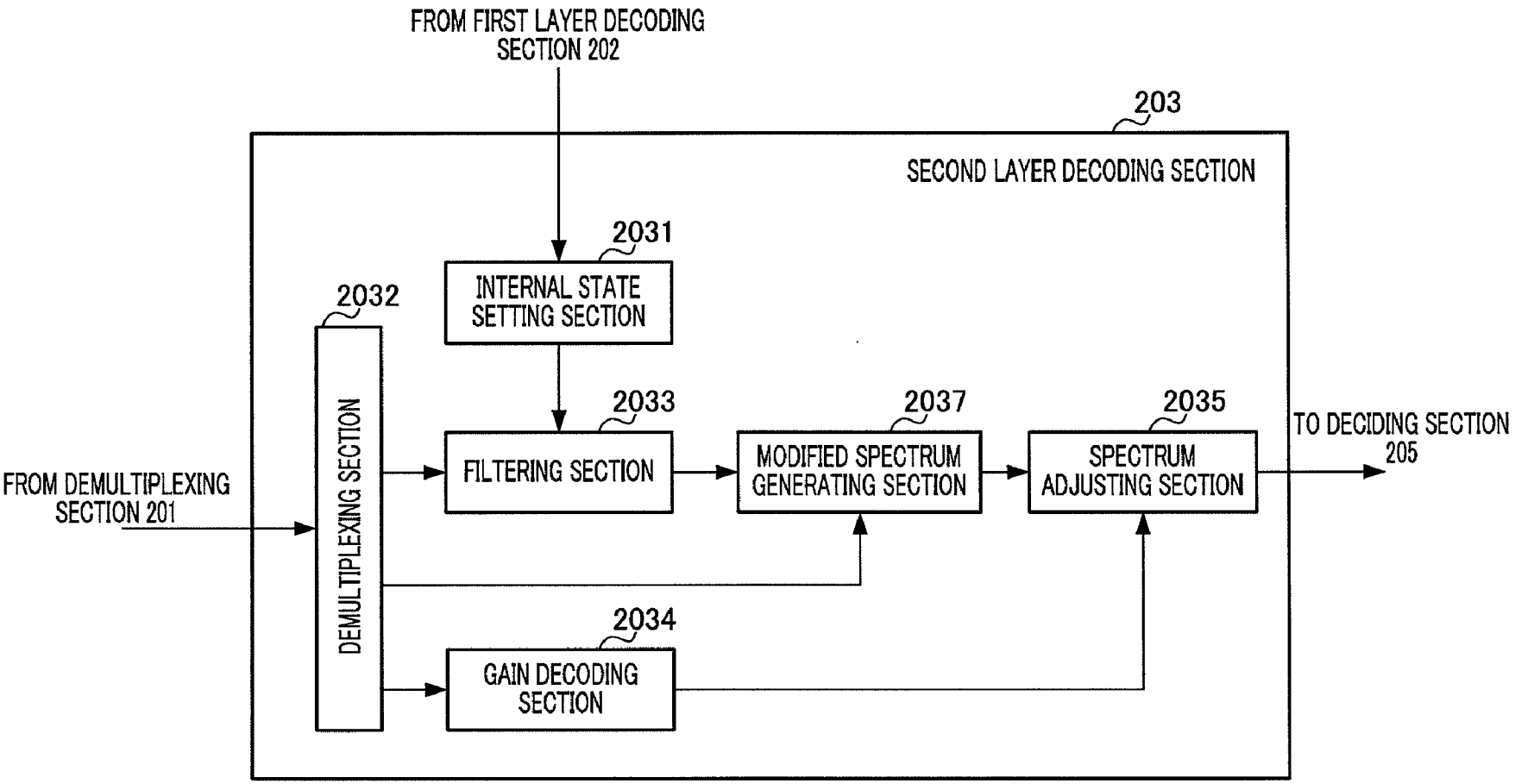
FIG. 33 is a block configuration diagram showing the second layer decoding section according to Embodiment 12 of the present invention.

Further, if second layer encoding section 108 does not include spectrum modifying section 1087, modified spectrum generating section 2036, which is corresponding to spectrum modifying section 1087, is not necessary in the speech decoding apparatus. Then, FIG. 33 shows the configuration of second layer decoding section 203 according to Embodiment 12.

Embodiments of the present invention have been described.

Further, second layer encoding section 108 according to Embodiments 6 to 12 may be employed in Embodiment 2 (FIG. 1), Embodiment 3 (FIG. 13), Embodiment 4 (FIG. 15), and Embodiment 5 (FIG. 17). In this case, in Embodiments 4 and 5 (FIGS. 15 and 17), the first layer decoded signal is up-sampled and then is transformed into the frequency domain, and so the frequency band of first layer decoded spectrum S1(*k*) is $0 \leqq k < FH$. However, the first layer decoded signal is simply up-sampled and then transformed into the frequency domain, and so band $FL \leqq k < FH$ does not include an effective signal component. Consequently, with these embodiments, the band of first layer decoded spectrum S1(*k*) is used as $0 \leqq k < FL$.

Further, second layer encoding section 108 according to Embodiments 6 to 12 may be used when encoding is carried out in the second layer of the speech encoding apparatus other than the speech encoding apparatus described in Embodiments 2 to 5.

Further, although cases have been described with the above embodiments where, after a pitch coefficient or an index is multiplexed at multiplexing section 1086 in second layer encoding section 108 and the multiplexed signal is outputted as the second layer encoded data, a bit stream is generated by multiplexing the first layer encoded data, the second layer encoded data and the LPC coefficient encoded data at multiplexing section 109, the embodiments are not limited to this, and a pitch coefficient or an index may be inputted directly to multiplexing section 109 and multiplexed over, for example, the first layer encoded data without providing multiplexing section 1086 in second layer encoding section 108. Further, although, in second layer decoding section 203, the second layer encoded data demultiplexed once from a bit stream and generated at demultiplexing section 201, is inputted to demultiplexing section 2032 in second layer decoding section 203 and is further demultiplexed to the pitch coefficient and the index, second layer decoding section 203 is not limited to this, and a bit stream may be directly demultiplexed to the pitch coefficient or the index and inputted to second layer decoding section 203 without providing demultiplexing section 2032 in second layer decoding section 203.

Further, although cases have been described with the above embodiments where the number of layers in scalable encoding is two, the embodiments are not limited to this, and the present invention can be applied to scalable encoding with three or more layers.

Further, although cases have been described with the above embodiments where the MDCT is employed as a transform encoding scheme in the second layer, the embodiments are not limited to this, and other transform encoding schemes such as the FFT, DFT, DCT, filter bank or Wavelet transform may be employed in the present invention.

Further, although cases have been described with the above embodiments where an input signal is a speech signal, the embodiments are not limited to this, and the present invention may be applied to an audio signal.

Further, it is possible to prevent speech quality deterioration in mobile communication by providing the speech encoding apparatus and the speech decoding apparatus according to the above embodiments in radio mobile station apparatus and a radio communication base station apparatus used in a mobile communication system. Furthermore, in the above embodiments, also, the radio communication mobile station apparatus and the radio communication base station apparatus may be referred to as UE and Node B, respectively.

Also, although cases have been described with the above embodiment as examples where the present invention is configured by hardware. However, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese patent application No. 2005-286533, filed on Sep. 30, 2005, and Japanese patent application No. 2006-199616, filed on Jul. 21, 2006, the entire content of which is expressly incorporated by reference herein.

INDUSTRIAL APPLICABILITY

The present invention can be applied for use in a radio communication mobile station apparatus or radio communication base station apparatus used in a mobile communication system.

The invention claimed is:

1. A speech encoding apparatus, comprising:

a first encoder that encodes a low band spectrum having a lower band than a threshold frequency of a speech signal;

a flattening circuit that flattens the low band spectrum using an inverse filter with inverse characteristics of a spectral envelope of the speech signal; and a second encoder that encodes a high band spectrum having a higher band than the threshold frequency of the speech signal using the flattened low band spectrum, wherein the second encoder modifies the flattened low band spectrum such that a dynamic range of the flattened low band spectrum is adjusted to be closer to a dynamic range of the high band spectrum and encodes the high band spectrum using the modified low band spectrum, and the second encoder modifies the flattened low band spectrum using an encoding candidate that decreases a dynamic range preferentially over an encoding candidate that increases the dynamic range, among a plurality of encoding candidates.

2. The speech encoding apparatus according to claim 1, wherein the flattening circuit forms the inverse filter using linear prediction coding coefficients of the speech signal.

3. The speech encoding apparatus according to claim 1, wherein the flattening circuit changes a degree of flattening according to a degree of resonance of the speech signal.

4. The speech encoding apparatus according to claim 3, wherein the flattening circuit sets the degree of flattening lower when the degree of resonance is greater.

5. The speech encoding apparatus according to claim 1, wherein the second encoder estimates the high band spectrum from the flattened low band spectrum, modifies the estimated high band spectrum and encodes the high band spectrum of the speech signal by using the modified high band spectrum.

6. A radio communication mobile station apparatus comprising the speech encoding apparatus according to claim 1.

7. A radio communication base station apparatus comprising the speech encoding apparatus according to claim 1.

8. The speech encoding apparatus according to claim 1, wherein the second encoder carries out correction such that an encoding candidate search target value becomes smaller, and, based on the corrected target value, searches for an encoding candidate used to modify the flattened low band spectrum among the plurality of encoding candidates.

9. The speech encoding apparatus according to claim 1, wherein the second encoder estimates the high band spectrum from the modified low band spectrum, modifies the estimated high band spectrum and encodes the high band spectrum of the speech signal by using the modified high band spectrum.

10. A speech encoding method, comprising:

encoding, by a first encoder, a low band spectrum having a lower band than a threshold frequency of a speech signal;

flattening, by a flattering circuit, the low band spectrum using an inverse filter with inverse characteristics of a spectral envelope of the speech signal; and encoding, by a second encoder, a high band spectrum having a higher band than the threshold frequency of the speech signal using the flattened low band spectrum, wherein the second encoder modifies the flattened low band spectrum such that a dynamic range of the flattened low band spectrum is adjusted closer to a dynamic range of the high band spectrum and encodes the high band spectrum using the modified low band spectrum, and the second encoder modifies the flattened low band spectrum using an encoding candidate that decreases a dynamic range preferentially over an encoding candidate that increases the dynamic range, among a plurality of encoding candidates.

* * * * *